US006524702B1

(12) United States Patent
Betso et al.

(10) Patent No.: US 6,524,702 B1
(45) Date of Patent: Feb. 25, 2003

(54) ELECTRICAL DEVICES HAVING POLYMERIC MEMBERS

(75) Inventors: Stephen R. Betso, Leipzig (DE); Martin J. Guest, Lake Jackson, TX (US); Richard M. Remenar, Pearland, TX (US); Arnold W. Field, Llangollen (GB); Alan Friday, Ashton-in-Makerfield (GB); James Freestone, Avon, IN (US); Ian Reynolds, Cambridge (GB); Fiona E. Keen, Chester (GB); Jerker B. I. Kjellqvist, Wadenswil (CH); Caecile F. Fassian, Leuna (DE); Mark R. Easter, Indianapolis, IN (US); Steven Betteridge, Gayton (GB); Jill M. Martin, Pearland, TX (US)

(73) Assignee: Dow Global Technologies Inc., Midland, MI (US)

( * ) Notice: Subject to any disclaimer, the term of this patent is extended or adjusted under 35 U.S.C. 154(b) by 0 days.

(21) Appl. No.: 09/374,099

(22) Filed: Aug. 12, 1999

(51) Int. Cl.[7] ..... D02G 3/00; H01B 7/00

(52) U.S. Cl. ..... 428/379; 428/375; 174/110 PM

(58) Field of Search ..... 428/325, 379; 174/110 PM

(56) References Cited

U.S. PATENT DOCUMENTS

| | | | | |
|---|---|---|---|---|
| 4,076,698 | A | 2/1978 | Anderson et al. | 526/348.6 |
| 4,150,193 | A | 4/1979 | Burns, Jr. | 428/517 |
| 4,226,823 | A | 10/1980 | Jansson et al. | 264/174 |
| 4,493,787 | A | 1/1985 | Taniguchi et al. | 252/511 |
| 4,748,209 | A | 5/1988 | Orikasa et al. | 525/240 |
| 4,993,107 | A | 2/1991 | Zoni | 45/352 |

(List continued on next page.)

FOREIGN PATENT DOCUMENTS

| | | | |
|---|---|---|---|
| EP | 341644 | 11/1989 | H01B/3/44 |
| EP | 416815 | 3/1991 | C08F/10/00 |
| JP | 00-119456 | 4/2000 | C08L/23/08 |
| WO | 94/00500 | 1/1994 | C08F/10/00 |
| WO | 95/32095 | 11/1995 | B32B/27/32 |
| WO | 98/09999 A2 | 3/1998 | C08F/210/02 |
| WO | 98/09999 A3 | 3/1998 | C08F/210/00 |
| WO | 98/10017 | 3/1998 | C08L/25/02 |
| WO | 99/20685 | 10/1998 | |

OTHER PUBLICATIONS

Derwent Abstract 1999–452999.

Japanese Abstract 09 003277 Jan. 7, 1997.

Japanese Abstract 01 115949 May 9, 1989.

Japanese Abstract 09 165475 Jun. 24, 1997.

James C. Randall, Polymer Sequence Determination Carbon–13 NMR Method, pp. 71–87, (1977).

*Primary Examiner*—Cynthia H. Kelly
*Assistant Examiner*—J. M. Gray

(57) ABSTRACT

The present invention relates to electrically conductive devices comprising at least one electrically conductive substrate surrounded by an interpolymer composition. The interpolymer composition comprises at least one substantially random interpolymer comprising:

(i) polymer units derived from:
- (a) at least one vinyl or vinylidene aromatic monomer, or
- (b) at least one hindered aliphatic or cycloaliphatic vinyl or vinylidene monomer; or
- (c) a combination of at least on vinyl or vinylidene aromatic monomer and at least one hindered aliphatic or cycloaliphatic vinyl or vinylidene monomer; and (ii) polymer units derived from at least one aliphatic olefin monomer having from about 2 to about 20 carbon atoms. Such devices include, for example, wire and cable assemblies.

22 Claims, 1 Drawing Sheet

U.S. PATENT DOCUMENTS 5,055,438 A 10/1991 Canich ..... 502/117
5,057,475 A 10/1991 Canich et al. ..... 502/104
5,064,802 A 11/1991 Stevens et al. ..... 502/155
5,096,867 A 3/1992 Canich ..... 502/103
5,132,380 A 7/1992 Stevens et al. ..... 526/126
5,189,192 A 2/1993 LaPointe et al. ..... 556/11
5,244,996 A 9/1993 Kawasaki et al. ..... 526/347
5,246,783 A 9/1993 Spenadel et al. ..... 428/461
5,321,106 A 6/1994 LaPointe ..... 526/126
5,347,024 A 9/1994 Nickias et al. ..... 556/11
5,350,723 A 9/1994 Neithamer et al. ..... 502/104
5,374,696 A 12/1994 Rosen et al. ..... 526/126
5,399,635 A 3/1995 Neithamer et al. ..... 526/126
5,470,993 A 11/1995 Spencer et al. ..... 502/107
5,703,187 A 12/1997 Timmers ..... 526/282
5,721,185 A 2/1998 LaPointe et al. ..... 502/117
5,869,591 A 2/1999 McKay et al. ..... 526/347
5,872,201 A 2/1999 Cheung et al. ..... 526/282
5,883,213 A 3/1999 Arai et al. ..... 526/347

ELECTRICAL DEVICES HAVING POLYMERIC MEMBERS

CROSS-REFERENCE TO RELATED APPLICATIONS

Not Applicable

STATEMENT REGARDING FEDERALLY SPONSORED RESEARCH OR DEVELOPMENT

Not Applicable

FIELD OF THE INVENTION

The present invention relates to electrically conductive or semi-conductive devices. In particular, this invention relates to electrically conductive or semi-conductive devices comprising an electrically conductive substrate surrounded by a composition comprising an interpolymer of at least one vinyl and/or vinylidene monomer and at least one ethylene and/or -α-olefin monomer. Even more particularly, this invention relates to electrically conductive or semi-conductive devices comprising polymeric insulating or semi-conducting compositions, which have improved electrical properties, service life, and other important properties. The present invention also relates to wires and cables, and ancillary devices, suitable for power transmission or telecommunication.

BACKGROUND AND SUMMARY OF THE INVENTION

Typical power cables, including those for small appliances to outdoor station-to-station power cables, often comprise one or more conductors in a core that may be surrounded by one or more layers. These layers may include one or more of the following: a first polymeric semi-conducting shield layer; a polymeric insulating layer; a second polymeric semi-conducting shield layer; and optionally, a metallic tape shield; and a polymeric jacket.

A wide variety of polymeric materials have been utilized as electrical insulating and semi-conducting shield materials for power cables and in other numerous applications. In order to be utilized in services or products where long term performance is desired or required, such polymeric materials, in addition to having suitable dielectric properties, must also be enduring and must substantially retain their initial properties for effective and safe performance over many years of service. For example, polymeric insulation utilized in building wire, electrical motor or machinery power wires, underground power transmitting cables, fiber optic telecommunication cables, and even small electrical appliances must be enduring not only for safety, but also out of economic necessity and practicality. Non-enduring polymeric insulation on building electrical wire or underground transmission cables may result in having to replace such wire or cable frequently.

Common polymeric compositions for use in electrical devices are made from polyvinylchloride (PVC), polyethylene homopolymers, ethylene/vinyl acetate (EVA) copolymer or ethylene-propylene elastomers, otherwise known as ethylene-propylene-rubber (EPR). Each of these polymeric compositions is often undesirable for one or more reasons. For instance, the use and disposal of PVC is often heavily regulated for environmental reasons and a suitable substitute material for use in electrical insulation would be desirable.

Polyethylene is generally used neat without a filler as an electrical insulation material. There have been attempts in the prior art to make polyethylene-based polymers with long term electrical stability. For example, polyethylene has been crosslinked with dicumyl peroxide in order to combine the improved physical performance at high temperature and have the peroxide residue function as an inhibitor of the propagation of electrical charge through the polymer, a process known as tree formation. Unfortunately, these residues are often degraded at most temperatures they would be subjected to in electrical power cable service.

Another class of polymers exists today, and is generally referred to as linear polyethylenes. These types of polymers are described in EPA Publication 0 341 644 published Nov. 15, 1989. Such polyethylenes are produced by a Ziegler-Natta catalyst system and generally have a broad molecular weight distribution similar to linear low density polyethylene and, at low enough polymer density, can also retard tree formation. Such linear type polymers in the wire and cable industry have poor melt temperature characteristics and also must also be cross-linked in order to withstand the high temperatures experienced in wire and cable applications. However, in order to achieve a good mix in an extruder, such linear polymers must be processed at a temperature at which traditionally used peroxides prematurely crosslink the polymers, a phenomenon commonly referred to as "scorch". If the processing temperature is held low enough to avoid scorch, incomplete melting occurs because of the higher melting species in linear polymers with a broad molecular weight distribution. This phenomenon often results in poor mixing, surging extruder pressures, and other poor results.

In contrast to polyethylene, EPR is generally used as an electrical insulator in combination with a high level of filler (typically about 20 to 50 percent by weight). Unfortunately, this combination of EPR and filler usually gives poor dielectric properties.

The use of fillers in combination with substantially random interpolymers for ignition resistant applications is disclosed in a copending U.S. Application by S. R. Betso et al., entitled "Compositions Having Improved Ignition Resistance" filed on the same day as the instant application. Also the use of fillers in combination with substantially random interpolymers for use in sound management applications is disclosed in a copending U.S. Application by B. Walther et al., entitled "Interpolymer Compositions For Use In Sound Management" filed on the same day as the instant application. The entire contents of both of these copending applications are incoporated herein by reference However, a need exists for polymeric insulation having good mechanical and electrical properties and good processability. This invention relates to electrical devices having a polymeric insulating and/or conductive member that exhibit unexpectedly and surprisingly improved electrical and mechanical properties, as well as, good processability.

According to one aspect of the present invention there is provided an electrically conductive device comprising at least one electrically conductive substrate surrounded by a composition comprising at least one substantially random interpolymer comprising:

(i) polymer units derived from
  (a) at least one vinyl or vinylidene aromatic monomer; or
  (b) at least one hindered aliphatic or cycloaliphatic vinyl or vinylidene monomer; or
  (c) a combination of at least one vinyl or vinylidene aromatic monomer and at least one hindered aliphatic or cycloaliphatic vinyl or vinylidene monomer; and (ii) polymer units derived from at least one aliphatic olefin monomer having from about 2 to about 20 carbon atoms.

According to another aspect of the present invention there is provided an electrically conductive device comprising (a) at least one electrically conductive substrate; and (b) at least one semi-conductive composition in proximity to the electrically conductive substrate. In this aspect, the semi-conducting composition comprises at least one substantially random interpolymer as described above.

According to yet another aspect of the present invention, there is provided an electrically conductive device comprising (a) at least one electrically conductive substrate; (b) at least one semi-conductive composition; and (c) an electrically insulating composition in proximity to the semi-conductive composition. In this aspect, the semi-conductive composition and/or the electrically insulating composition comprise a composition comprising at least one substantially random interpolymer as described above.

According to yet another aspect of the present invention, there is provided an electrically conductive device comprising: (a) at least one electrically conductive substrate; (b) a first semi-conductive composition; (c) an electrically insulating composition in proximity to the first semi-conductive composition and which forms a substrate for a second semi-conductive composition; and (d) a second semi-conductive composition. In this aspect, either semi-conductive member, or both the semi-conductive members, and/or the electrically insulating composition comprise a composition comprising at least one substantially random interpolymer as described above.

According to yet another aspect of the present invention there is provided an electrically conductive device comprising: (a) at least one electrically conductive substrate; and (b) a first semi-conductive composition; (c) an electrically insulating composition in proximity to the first semi-conductive composition and which forms a substrate for the second semi-conductive composition; (d) a second semi-conductive composition; and (e) at least one protective layer. In this aspect, the first and/or the second semi-conductive composition(s) and/or the electrically insulating composition and/or the protective layer comprise a composition comprising at least one substantially random interpolymer as described above.

According to yet another aspect of the present invention there is provided an electrically conductive device comprising: (a) at least one electrically conductive substrate; and (b) at least one protective or insulating layer. In this aspect, the protective or insulating layer comprises a composition comprising at least one substantially random interpolymer as described above.

According to still yet another aspect of the present invention there is provided an electrically conductive device comprising: (a) a plurality of conductors enclosed within a sheath; and interstices between individual conductors and between the conductors and the sheath, wherein the interstices are filled with a composition comprising at least one substantially random interpolymer as described above.

DETAILED DESCRIPTION OF THE INVENTION

Figure 1:
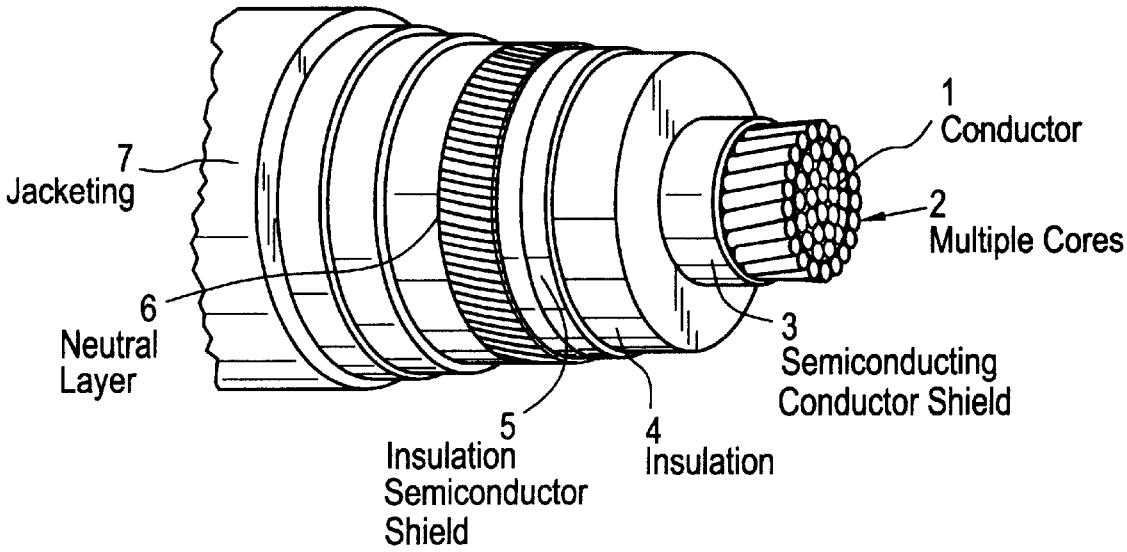
FIG. 1 is a cross-sectional illustration of a specific cable of the present invention, and shows a multiplicity of conducting substrates comprising the conductive core that is substantially surrounded by several protective layers that are either jacket, neutral, insulator or semi-conductive shields layers.

The present invention particularly relates to electrically conductive devices and products comprising substantially random interpolymers used as insulating compositions, semi-conductor compositions, protective layers, or fill material, wherein the devices and products have the unique combination of good mechanical and electrical properties, and processability. Surprising and unexpected properties of the interpolymers described herein in electrical devices include, but are not limited to, the following beneficial properties: low dielectric constant, flexibility, crosslinkability, lack of electrostatic buildup, improved aging, filler acceptance capability, transparency, adhesion to other polymers such as EVA, EBA (ethylene butyl acrylate), or LDPE, low gel formation, and lack of brittleness; suitable thermal and electrical conductivity, and suitable AC or DC breakdown strength.

The polymer used in the insulating compositions, semi-conductor compositions, protective layers, or fill material of the electrical devices of the present invention comprises at least one substantially random interpolymer derived from ethylene and/or α-olefin monomers and vinyl or vinylidene monomers.

The term "substantially random" in the substantially random interpolymer comprising ethylene and/or one or more α-olefins and one or more vinyl or vinylidene monomers, as used herein, means that the distribution of the monomers of said interpolymer can be described by the Bernoulli statistical model or by a first or second order Markovian statistical model, as described by J. C. Randall in *POLYMER SEQUENCE DETERMINATION, Carbon*$^{13}$ *NMR Method,* Academic Press New York, 1977, pp. 71–78. Preferably, the substantially random interpolymer does not contain more than 15 percent of the total amount of vinyl or vinylidene monomer in blocks of more than 3 units. More preferably, the interpolymer is not characterized by a high degree of either isotacticity or syndiotacticity. This means that in the carbon$^{-13}$ NMR spectrum of the substantially random interpolymer the peak areas corresponding to the main chain methylene and methine carbons representing either meso diad sequences or racemic diad sequences should not exceed 75 percent of the total peak area of the main chain methylene and methine carbons.

The term "composition" as used herein includes a mixture of the materials which comprise the composition, as well as, products formed by the reaction or the decomposition of the materials which comprise the composition. Specifically included within the compositions of the present invention are grafted or coupled compositions wherein a coupling agent is present and reacts with at least a portion of the one or more interpolymers and/or at least a portion of the one or more fillers.

The term "interpolymer" is used herein to indicate a polymer wherein at least two different monomers are polymerized to make the interpolymer.

The term "derived from" means made or mixed from the specified materials, but not necessarily composed of a simple mixture of those materials. Compositions "derived from" specified materials may be simple mixtures of the original materials, and may also include the reaction products of those materials, or may even be wholly composed of reaction or decomposition products of the original materials.

The term "electrical device" or "electrically conductive device" as used herein means any apparatus that is capable of employing, storing, conducting, or transferring AC or DC current, or electromagnetic radiation, in some manner. The transmission efficiency (i.e., the opposite of the power loss) is defined as the ratio of power exiting the electrically conductive device, divided by the power entering the electrically conductive device. The minimum acceptable transmission efficiency is generally set by the specific application requiring power transmission. Generally, electrically conductive devices, as defined in this patent, have a power transmission efficiency of greater than about 75%.

The term includes fiber optical devices, telecommunication cables, power cables, conventional wire and cable systems, electrical plugs, electrical connectors, electrical harnesses, related ancillary devices, etc. Wire and cable systems specifically include all ranges of voltages, for example, household extension and appliance cords, control cables, and outdoor station-to-station power cables are within the scope of this invention.

The term "conductor" as used herein means any material, or substrate, capable of transmitting electricity, or electrical power, either in the form of an alternating or a direct current, from one location, or point, to another, some distance away, without a significant loss of energy or power. A conductor is typically defined as a solid, which affords continuous passage of an electric current when an electric field is applied. In ordinary engineering usage, a solid conductor is a material of high conductivity. The electrical conductivity of metallic conductors is of the order of $10^6$–$10^8$ $Sm^{-1}$ at temperatures on the vicinity of 0° K.

Generally, electrical conductors, as exemplified in this patent, are metallic in nature, and tend to obey a form of Ohm's Law, which is that $$I=E/R$$

where

I=current in amperes

E=electromotive force in volts

R=resistance in ohms.

Suitable electrical conductors are copper, aluminum, iron, sodium, steel, and the like. These materials are generally classified by their resistance, as defined as ohms×surface area/distance. Also included, in this definition, are materials, or substances, capable of transmitting electromagnetic energy, as light, from one location, or point, to another, some distance away, without a significant loss of energy or power. Materials included in this definition comprise glass, fiber optics, and other translucent substrates, which may not, necessarily, be conductors of electricity.

The term "insulator" as used herein means any material which inhibits, or prevents, the flow of electricity from one electrode (or conductor) to another. In the case of electrically conducting devices, the insulator inhibits the flow of electricity, or leakage, from one conductive substrate to another, or from the conductive substrate to an electrical or earth ground. Insulating substrates are generally defined by their resistance, as defined by a form of Ohm's Law, that may vary if the electric field is direct or alternating in nature. As exemplified in this patent, the insulators are dielectrics, i.e., nonconductors of direct electrical current, and are polymeric materials. The major characteristic of insulators is their enormous electrical resistance, typically a factor of $10^{20}$ larger than that of the typical conducting metals. Also included, in this definition, are materials, or substances, capable of inhibiting leakage of electromagnetic energy, such as light, from the conductor to the environment.

The term "semiconductor" or "semiconductive" as used herein means any material or property respectively that possesses intermediate resistance to electrical flow, between that of a conductor and an insulator. As exemplified in this patent, semiconductors comprise polymeric materials modified, by the addition of suitable conducting materials, such as Carbon-Black, metals, and the like, to increase their conductance to the desired level. In medium and high voltage AC power transmission, the voltages employed are of such high intensities that they are capable of damaging the polymeric insulation materials. Generally, the unevenness of the conductor, or conductors, creates slight, but significant, variances in the field stress distribution around their periphery. These variances in field stress can be of such magnitude such that they can damage the insulator or shorten its service life. In those instances, it is preferable to put a semiconducting substrate between the conductor and the insulator to moderate and homogenize the field stresses.

Again, in instances of medium and high voltage transmission, due to extended field stresses, and safety, it is often desirable to put a semiconducting substrate on the insulator surface furthest away from the conductor. This substrate can then act as a ground, to increase the safety of the device.

The term "surrounded" as used herein means substantially encircled or encompassed—particularly, but not limited to, in a longitudinal direction. In wire and cable, for example, a polymer which surrounds a substrate is generally in the form of a layer or coating which is, for example, wrapped around the substrate and which may or may not be in direct contact with the substrate. Thus, there may be one or more additional layers between the polymer-containing layer and the substrate and/or one or more additional layers wrapped around the polymer-containing layer.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 and the like, are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Interpolymers and Interpolymer/Polymer Blends

The interpolymers employed in the present invention include, but are not limited to substantially random interpolymers prepared by polymerizing ethylene and/or one or more α-olefin monomers with one or more vinyl or vinylidene monomers and optionally with one or more other polymerizable ethylenically unsaturated monomer(s).

Suitable α-olefin monomers include, for example, α-olefin monomers containing from 3 to 20, preferably from 3 to 12, more preferably from 3 to 8 carbon atoms. Preferred such monomers include propylene, butene-1, 4-methyl-1-pentene, hexene-1 and octene-1. Most preferred are ethylene or a combination of ethylene with $C_3$ to $C_8$-α-olefins. These α-olefins do not contain an aromatic moiety.

Suitable vinyl or vinylidene monomers which can be employed to prepare the interpolymers employed in the compositions of the present invention include, for example, those represented by the following formula:

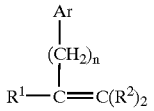

wherein $R^1$ is selected from the group of radicals consisting of hydrogen and alkyl radicals containing from 1 to 4 carbon atoms, preferably hydrogen or methyl; each $R^2$ is independently selected from the group of radicals consisting of hydrogen and alkyl radicals containing from 1 to 4 carbon atoms, preferably hydrogen or methyl; Ar is a phenyl group or a phenyl group substituted with from 1 to 5 substituents selected from the group consisting of halo, $C_{1-4}$-alkyl, and $C_{1-4}$-haloalkyl; and n has a value from zero to 4, preferably from zero to 2, most preferably zero. Particularly suitable such monomers include styrene and lower alkyl- or halogen-substituted derivatives thereof. Exemplary monovinylidene aromatic monomers include styrene, vinyl toluene, α-methylstyrene, t-butyl styrene or chlorostyrene, including all isomers of these compounds. Preferred monomers include styrene, α-methyl styrene, the lower alkyl-($C_1$–$C_4$) or phenyl-ring substituted derivatives of styrene, such as for example, ortho-, meta-, and para-methylstyrene, the ring halogenated styrenes, para-vinyl toluene or mixtures thereof. A more preferred aromatic monovinylidene monomer is styrene.

Also included are the hindered aliphatic or cycloaliphatic vinyl or vinylidene compounds, by which is meant addition polymerizable vinyl or vinylidene monomers corresponding to the formula:

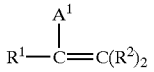

wherein $A^1$ is a hindered aliphatic or cycloaliphatic substituent of up to 20 carbons, $R^1$ is selected from the group of radicals consisting of hydrogen and alkyl radicals containing from 1 to about 4 carbon atoms, preferably hydrogen or methyl; each $R^2$ is independently selected from the group of radicals consisting of hydrogen and alkyl radicals containing from 1 to about 4 carbon atoms, preferably hydrogen or methyl; or alternatively $R^1$ and $A^1$ together form a ring system and in which one of the carbon atoms bearing ethylenic unsaturation is tertiary or quaternary substituted. The term "hindered" means that the monomer bearing this substituent is normally incapable of addition polymerization by standard Ziegler-Natta polymerization catalysts at a rate comparable with ethylene polymerizations. Examples of such substituents include cyclic aliphatic groups such as cyclohexyl, cyclohexenyl, cyclooctenyl, or ring alkyl or aryl substituted derivatives thereof, tert-butyl, norbornyl, and the like. Most preferred hindered aliphatic or cycloaliphatic vinyl or vinylidene compounds are the various isomeric vinyl-ring substituted derivatives of cyclohexene and substituted cyclohexenes, and 5-ethylidene-2-norbornene. Especially suitable are 1-, 3-, and 4-vinylcyclohexene. Simple linear non-branched α-olefins including for example, α-olefins containing from 3 to about 20 carbon atoms such as propylene, butene-1, 4-methyl-1-pentene, hexene-1 or octene-1 are not examples of sterically hindered aliphatic or cycloaliphatic vinyl or vinylidene compounds.

Other optional polymerizable ethylenically unsaturated monomer(s) include strained ring olefins such as norbornene and $C_{1-10}$ alkyl or $C_{6-10}$ aryl substituted norbornenes, with an exemplary interpolymer being ethylene/styrene/norbornene.

Polymerizations and unreacted monomer removal at temperatures above the autopolymerization temperature of the respective monomers may result in formation of some amounts of homopolymer polymerization products resulting from free radical polymerization. For example, while preparing the substantially random interpolymer, an amount of atactic vinyl aromatic homopolymer may be formed due to homopolymerization of the vinyl aromatic monomer at elevated temperatures. The presence of vinyl aromatic homopolymer is in general not detrimental for the purposes of the present invention and can be tolerated. The vinyl aromatic homopolymer may be separated from the interpolymer, if desired, by extraction techniques such as selective precipitation from solution with a non-solvent for either the interpolymer or the vinyl aromatic homopolymer. For the purpose of the present invention it is preferred that no more than 20 weight percent, preferably less than 15 weight percent based on the total weight of the interpolymers of vinyl aromatic homopolymer is present in the substantially random interpolymer component.

The substantially random interpolymers may be modified by typical grafting, hydrogenation, functionalizing, or other reactions well known to those skilled in the art. For example, the polymers may be readily sulfonated or chlorinated to provide functionalized derivatives according to established techniques.

Methods of Preparing the Interpolymers

The substantially random interpolymers can be prepared as described in U.S. application Ser. No. 07/545,403 filed Jul. 3, 1990 pending, (corresponding to EP-A-0,416,815) by James C. Stevens et al. and in U.S. Pat. Nos. 5,703,187 and 5,872,201, the entire contents of all of which are herein incorporated by reference. Preferred operating conditions for such polymerization reactions are pressures from atmospheric up to 3,000 atmospheres and temperatures from −30° C. to 200° C.

Examples of suitable catalysts and methods for preparing the substantially random interpolymers are disclosed in U.S. application Ser. No. 702,475, filed May 20, 1991 (EP-A-514,828); as well as U.S. Pat. Nos. 5,055,438; 5,057,475; 5,096,867; 5,064,802; 5,132,380; 5,189,192; 5,321,106; 5,347,024; 5,350,723; 5,374,696; 5,399,635; 5,470,993; 5,703,187; and 5,721,185 all of which patents and applications are incorporated herein by reference.

The substantially random α-olefin/vinyl aromatic interpolymers can also be prepared by the methods described in JP 07/278230 employing compounds shown by the general formula

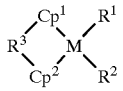

where $Cp^1$ and $Cp^2$ are cyclopentadienyl groups, indenyl groups, fluorenyl groups, or substituents of these, independently of each other; $R^1$ and $R^2$ are hydrogen atoms, halogen atoms, hydrocarbon groups with carbon numbers of 1–12, alkoxyl groups, or aryloxyl groups, independently of each other; M is a group IV metal, preferably Zr or Hf, most preferably Zr; and $R^3$ is an alkylene group or silanediyl group used to cross-link $Cp^1$ and $Cp^2$).

The substantially random α-olefin/vinyl aromatic interpolymers can also be prepared by the methods described by John G. Bradfute et al. (W. R. Grace & Co.) in WO 95/32095; by R. B. Pannell (Exxon Chemical Patents, Inc.) in WO 94/00500; and in *Plastics Technology,* p. 25 (September 1992), all of which are incorporated herein by reference in their entirety.

Also suitable are the substantially random interpolymers which comprise at least one α-olefin/vinyl aromatic/vinyl aromatic/α-olefin tetrad disclosed in U. S. application Ser. No. 08/708,869 filed Sep. 4, 1996 and WO 98/09999 both by Francis J. Timmers et al. These interpolymers contain additional signals in their carbon-13 NMR spectra with intensities greater than three times the peak to peak noise. These signals appear in the chemical shift range 43.70–44.25 ppm and 38.0–38.5 ppm. Specifically, major peaks are observed at 44.1, 43.9, and 38.2 ppm. A proton test NMR experiment indicates that the signals in the chemical shift region 43.70–44.25 ppm are methine carbons and the signals in the region 38.0–38.5 ppm are methylene carbons.

It is believed that these new signals are due to sequences involving two head-to-tail vinyl aromatic monomer insertions preceded and followed by at least one α-olefin insertion, e.g. an ethylene/styrene/styrene/ethylene tetrad wherein the styrene monomer insertions of said tetrads occur exclusively in a 1,2 (head to tail) manner. It is understood by one skilled in the art that for such tetrads involving a vinyl aromatic monomer other than styrene and an α-olefin other than ethylene that the ethylene/vinyl aromatic monomer/vinyl aromatic monomer/ethylene tetrad will give rise to similar carbon-13 NMR peaks but with slightly different chemical shifts.

These interpolymers can be prepared by conducting the polymerization at temperatures of from about −30° C. to about 250° C. in the presence of such catalysts as those represented by the formula

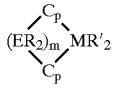

wherein: each Cp is independently, each occurrence, a substituted cyclopentadienyl group π-bound to M; E is C or Si; M is a group IV metal, preferably Zr or Hf, most preferably Zr; each R is independently, each occurrence, H, hydrocarbyl, silahydrocarbyl, or hydrocarbylsilyl, containing up to about 30 preferably from 1 to about 20 more preferably from 1 to about 10 carbon or silicon atoms; each R' is independently, each occurrence, H, halo, hydrocarbyl, hyrocarbyloxy, silahydrocarbyl, hydrocarbylsilyl containing up to about 30 preferably from 1 to about more preferably from 1 to about 10 carbon or silicon atoms or two R' groups together can be a $C_{1-10}$ hydrocarbyl substituted 1,3-butadiene; m is 1 or 2; and optionally, but preferably in the presence of an activating cocatalyst. Particularly, suitable substituted cyclopentadienyl groups include those illustrated by the formula:

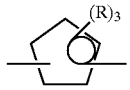

wherein each R is independently, each occurrence, H, hydrocarbyl, silahydrocarbyl, or hydrocarbylsilyl, containing up to about 30 preferably from 1 to about 20 more is preferably from 1 to about 10 carbon or silicon atoms or two R groups together form a divalent derivative of such group. Preferably, R independently each occurrence is (including where appropriate all isomers) hydrogen, methyl, ethyl, propyl, butyl, pentyl, hexyl, benzyl, phenyl or silyl or (where appropriate) two such R groups are linked together forming a fused ring system such as indenyl, fluorenyl, tetrahydroindenyl, tetrahydrofluorenyl, or octahydrofluorenyl.

Particularly preferred catalysts include, for example, racemic-(dimethylsilanediyl)-bis-(2-methyl-4-phenylindenyl) zirconium dichloride, racemic-(dimethylsilanediyl)-bis-(2-methyl-4-phenylindenyl) zirconium 1,4-diphenyl-1,3-butadiene, racemic-(dimethylsilanediyl)-bis-(2-methyl-4-phenylindenyl) zirconium di-C1–4 alkyl, racemic-(dimethylsilanediyl)-bis-(2-methyl-4-phenylindenyl) zirconium di-C1–4 alkoxide, or any combination thereof and the like.

It is also possible to use the following titanium-based constrained geometry catalysts, [N-(1,1-dimethylethyl)-1,1-dimethyl-1-[(1,2,3,4,5-η)-1,5,6,7-tetrahydro-s-indacen-1-yl]silanaminato(2-)-N]titanium dimethyl; (1-indenyl)(tert-butylamido)-dimethyl-silane titanium dimethyl; ((3-tert-butyl)(1,2,3,4,5-η)-1-indenyl)(tert-butylamido) dimethylsilane titanium dimethyl; and ((3-iso-propyl)(1,2,3,4,5-η)-1-indenyl)(tert-butyl amido)dimethylsilane titanium dimethyl, or any combination thereof and the like.

Further preparative methods for the interpolymers of the present invention have been described in the literature. Longo and Grassi (Makromol. Chem., Volume 191, pages 2387 to 2396 [1990]) and D'Anniello et al. (Journal of Applied Polymer Science, Volume 58, pages 1701 to 1706 [1995]) reported the use of a catalytic system based on methylalumoxane (MAO) and cyclopentadienyltitanium trichloride ($CpTiCl_3$) to prepare an ethylene-styrene copolymer. Xu and Lin (Polymer Preprints, Am. Chem. Soc., Div. Polym. Chem., volume 35, pages 686, 687 [1994]) have reported copolymerization using a $MgCl_2/TiCl_4/NdCl_3/Al(iBu)_3$ catalyst to give random copolymers of styrene and propylene. Lu et al. (Journal of Applied Polymer Science, volume 53, pages 1453 to 1460 [1994]) have described the copolymerization of ethylene and styrene using a $TiCl_4/NdCl_3/MgCl_2/Al(Et)_3$ catalyst. Sernetz and Mulhaupt, (Macromol. Chem. Phys., volume 197, pages 1071 to 1083 [1997]) have described the influence of polymerization conditions on the copolymerization of styrene with ethylene using $Me_2Si(Me_4Cp)(N\text{-}tert\text{-}butyl)TiCl_2$/methylaluminoxane catalysts. The manufacture of α-olefin/vinyl aromatic monomer interpolymers such as ethylene/sytrene, propylene/styrene and butene/styrene are described in U.S. Pat. No. 5,244,996, issued to Mitsui Petrochemical Industries Ltd, or as disclosed in DE 197 11 339 A1 and U.S. Pat. No. 5,883,213 both to Denki Kagaku Kogyo K K. All the above methods disclosed for preparing the interpolymer component are incorporated herein by reference. Also the random copolymers of ethylene and styrene as disclosed in Polymer Preprints Vol. 39, No. 1, March 1998 by Toru Aria et al. can also be employed as blend components for the present invention.

The polymers utilized in the present invention may be crosslinked chemically or with radiation. Suitable free radical crosslinking agents include organic peroxides such as dicumyl peroxide, hydrolyzed silanes, organic azides, or a combination thereof. Alternatively, the interpolymer may be crosslinked by grafting of a silane to the backbone followed by hydrolysis to form crosslinks between adjacent polymer chains via siloxane linkages. This is the so called moisture cure technique.

Interpolymers Having Improved Electrical Breakdown Strength

Interpolymers of the present invention which are particularly suitable for electrical devices are interpolymers having a surprising and unexpected electrical breakdown strength, measured under an alternating current field stress at less than 500 Hz, preferably at 50 Hz. Thus, a particularly preferred interpolymer of the present invention comprises at least one substantially random interpolymer comprising polymer units derived from at least one vinyl or vinylidene monomer and polymer units derived from ethylene and/or at least one $C_3$ to $C_{20}$ α-olefin wherein, when the interpolymer is tested in an Applied Field Stress range of $\log_{10}$ (Applied Field Stress in V/m)≧8.00, but ≦8.25, it has a $\log_{10}$ (Endurance Time in Seconds) of ≧{8.56[8.00−$\log_{10}$ (Applied Field Stress in V/m)]+5.0}; preferably of ≧{8.56[8.00−$\log_{10}$ (Applied Field Stress in V/m)]+4.7}; and most preferably of ≧{8.56[8.00−$\log_{10}$ (Applied Field Stress in V/m)]+4.38}.

Substantially random interpolymers according to the equation above can be made according to the above-described methods of preparing the interpolymers. The interpolymers are then tested according to the following breakdown test to determine whether the electrical breakdown strength is greater than or equal to that required. If the electrical breakdown strength of interpolymer is below that required then it may be advantageous to vary the method in which the interpolymer is prepared or solvent or steam strip the interpolymer.

Described below is a particularly desirable process of preparing interpolymers having the desired values of $\log_{10}$ (Endurance Time in Seconds).

1) Dissolve the substantially random interpolymer in a suitable solvent (cyclohexane at about 5–10% interpolymer is often suitable; the exact solvent may be dictated by the exact comonomer composition of the interpolymer);
2) Mix the interpolymer solution with methanol and precipitate the interpolymer;
3) Re-dissolve and precipitate the polymer from step 2 (as in steps 1 and 2);
4) Dry and devolatilize the interpolymer.

Another suitable process is to

1) Dissolve the interpolymer in a suitable solvent (cyclohexane at about 5–10% interpolymer is often suitable; the exact solvent may be dictated by the exact comonomer composition of the interpolymer);
2) Wash the dissolved interpolymer with an aqueous solution of 1% HCl;
3) Wash the dissolved interpolymer with an aqueous solution of 1% NaOH;
4) Wash the dissolved interpolymer with de-ionized water;
5) Precipitate the washed interpolymer with methanol;
6) Dry and devolatilize the precipitated interpolymer.

Another suitable method comprises "steam stripping," a process whereby high pressure steam is introduced into the molten or dissolved interpolymer, dispersed homogeneously through it, then removed. The resultant interpolymer composition is then processed and dried conventionally.

Preferred interpolymers for electrical devices include the substantially random interpolymers, wherein the at least one substantially random interpolymer comprises one or more vinyl aromatic monomers in combination with ethylene or a combination of ethylene and one or more $C_3$ to $C_8$ alpha olefin monomers, or a combination of ethylene and norbornene. Particularly preferred polymers also include those wherein the at least one substantially random interpolymer is selected from the group consisting of ethylene/styrene, ethylene/propylene/styrene, ethylene/butene/styrene, ethylene/pentene/styrene, ethylene/hexene-1/styrene, or ethylene/octene-1/styrene.

For the semi-conducting conductor shielding layer of the present invention, the substantially random interpolymer component interpolymers usually contain from about 3 to about 65, preferably from about 3 to about 55, more preferably from about 5 to about 40, most preferably from about 6 to about 15 mole percent of at least one vinyl or vinylidene aromatic monomer and from about 35 to about 97, preferably from about 45 to about 97, more preferably from about 60 to about 95, most preferably from about 85 to about 94 mole percent of ethylene and/or at least one aliphatic α-olefin having from 3 to 20 carbon atoms.

The melt index $I_2$ according to ASTM D 1238 Procedure A, condition E, generally is from about 0.01 to about 50 g/10 min., preferably from about 1 to about 40 g/10 min., more preferably from about 5 to about 30 g/10 min., and most preferably from about 5 to about 20 g/10 min.

For the insulation layer of the present invention, the substantially random interpolymer component interpolymers usually contain from about 3 to about 65, preferably from about 3 to about 55, more preferably from about 3 to about 40, most preferably from about 3 to about 13 mole percent of at least one vinyl or vinylidene aromatic monomer and from about 35 to about 97, preferably from about 45 to about 97, more preferably from about 60 to about 97, most preferably from about 87 to about 97 mole percent of ethylene and/or at least one aliphatic α-olefin having from 3 to 20 carbon atoms.

The melt index $I_2$ according to ASTM D 1238 Procedure A, condition E, generally is from about 0.01 to about 50 g/10 min., preferably from about 0.01 to about 20 g/10 min., more preferably from about 0.1 to about 10 g/10 min., and most preferably from about 0.5 to about 5 g/10 min.

For the semi-conducting insulation shielding layer of the present invention, the substantially random interpolymer component interpolymers usually contain from about 3 to about 65, preferably from about 3 to about 55, more preferably from about 5 to about 40, most preferably from about 10 to about 20 mole percent of at least one vinyl or vinylidene aromatic monomer and from about 35 to about 97, preferably from about 45 to about 97, more preferably from about 60 to about 95, most preferably from about 80 to about 90 mole percent of ethylene and/or at least one aliphatic α-olefin having from 3 to 20 carbon atoms.

The melt index $I_2$ according to ASTM D 1238 Procedure A, condition E, generally is from about 0.01 to about 50 g/10 min., preferably from about 1 to about 40 g/10 min., more preferably from about 5 to about 30 g/10 min., and most preferably from about 5 to about 20 g/10 min.

For the jacket or protective layer of the present invention, the substantially random interpolymer component interpolymers usually contain from about 3 to about 65, preferably from about 3 to about 55, more preferably from about 3 to about 40, most preferably from about 3 to about 13 mole percent of at least one vinyl or vinylidene aromatic monomer and from about 35 to about 97, preferably from about 45 to about 97, more preferably from about 60 to about 97, most preferably from about 87 to about 97 mole percent of ethylene and/or at least one aliphatic α-olefin having from 3 to 20 carbon atoms.

The melt index $I_2$ according to ASTM D 1238 Procedure A, condition E, generally is from about 0.01 to about 50 g/10 min., preferably from about 0.01 to about 20 g/10 min., more preferably from about 0.1 to about 10 g/10 min., and most preferably from about 0.5 to about 5 g/10 min.

Interpolymer Blends

Also within the scope of this invention are interpolymers in a blended composition with other polymers. Any other polymer may be used for blending with the interpolymer according to this invention. Additional polymers blended with the interpolymers of the present invention may prove especially useful in manipulating the properties of the total composition. The use of additional polymers to form a blended polymer-interpolymer component in the claimed compositions may provide more preferred mechanical strength or tensile strength characteristics. One of skill in the art will choose polymers that impart certain desired characteristics to the final blend-containing composition and do not adversely affect the electrical properties and/or the service life of the device.

An additional advantageous result of blending the interpolymer with another polymer is economic in nature. The interpolymers of the claimed compositions may be made increasingly cost efficient when combined with less expensive polymers in a blended composition that displays desirable characteristics.

As is clear from the discussion above, the present invention expressly includes compositions in which an additional polymer is blended with the interpolymer in amounts necessary to impart desirable qualities to the composition as a whole. Alternatively, it is also envisioned that trace amounts of additional polymers may be "blended" with the interpolymer of the composition such that no measurable change in composition characteristics is observed. This embodiment is advantageous when the disclosed interpolymer compositions are manufactured in a system containing residual amounts of polymer that may have been previously synthesized or otherwise processed in that system. Likewise, a further advantage of the presently disclosed compositions is that they are often capable of being mixed with any number of such materials in a manufacturing processes.

Acceptable polymers to blend with the claimed interpolymers include, but are not limited to, co-polymers of ethylene with octene (or hexene or butene), Engage™ polyolefin elastomers (POE), Exact™ polymers, very- or ultra-low density polyethylenes (VLDPE or ULDPE), EVA, EBA, Affinity™, Affinity™ polyolefin plastomers (Affinity™ POPs), polystyrene and styrene copolymers, polypropylene and propylene copolymers, and polyphenylene oxide, and the like. Additionally, any polyolefin plastomer (POP), any terpolymer such as ethylene propylene diene rubber (EPDM), any polyethylene octene, hexene, butene, or other like co-polymer, styrene butadiene rubbers and elastomers, and partially and fully hydrogenated SB rubbers will work advantageously in the compositions of the present invention.

A particularly preferable blend includes a blend of the substantially random interpolymer with up to 90 percent by weight of at least one thermoplastic polymer selected from ethylene homopolymer and copolymers, propylene homopolymer and copolymers, styrenic homopolymer and copolymers, polyaromatic ethers, and polyvinyl halides.

Types of blends that are useful in the compositions disclosed herein include mechanical blends, in which the polymers are mixed at temperatures above the $T_g$ or $T_m$ (crystalline melting temperature) for the amorphous or crystalline polymers respectively. Also included are mechano-chemical blends in which the polymers are mixed under conditions sufficiently rigorous enough to cause degradation. When using mechano-chemical blends, care must be taken to control combination of resultant free radicals which form complex mixtures including graft and block compositions. Solution-cast blends and latex blends are also useful according to the present invention; as are a variety of interpenetrating polymer network blends.

The polymer blends of the present invention can be prepared by any conventional compounding operation, such as for example single and twin screw extruders, Banbury mixers, Brabender mixers, Farrel continuous mixers, and two roll mills. The order of mixing and the form of the blend components to be mixed is not critical; but rather, it may vary depending on the particular requirements or needs of the individual compounder. The mixing temperatures are preferably such that an intimate blend is obtained of the components. Typical temperatures are above the softening or melting points of at least one of the components, and more preferably above the softening or melting points of all the components.

Processing Agents

In addition to the core components of interpolymer or interpolymer-polymer blend, compositions of the present invention may further contain any one or a combination of a variety of processing agents. Examples of processing agents are those substances that improve the processability or mechanical properties of the composition; they may be a tackifier, an oil, a plasticizer, or an antioxidant or a combination thereof. Such substances are selected for use depending upon the needs of the formulator, and the desired characteristics of the final composition. Various additional other components may also be added to the disclosed compositions, as needed to suit the needs of the formulator, and, in such a way as to not destroy the benefits of the interpolymer in the present invention. These additives may be used selectively in one component of the device (e.g., the semi-conductive shield) and not be used in another component of the device (e.g., the insulator). One of skill in the art will use these agents as appropriate to the electrical device.

When processing agents are employed in the present invention, they may be used alone, or in combination with other processing agents, to synergistically achieve similar properties, or to achieve different resultant properties in the end composition. Effective amounts of processing agents in the present invention range from about 0.01 to about 50 percent of the composition, by weight, depending upon the particular processing agent and its role in the composition developed by an individual formulator. More preferably, processing agent amounts range from about 0.3 to about 35 percent by weight; and, most preferably, from about 0.5 to about 25 percent by weight.

Tackifiers

Tackifiers that are useful in the present invention can be any number of substances, including those that are commercially available and well-known by those of skill in the art, such as those listed in U.S. Pat. No. 3,484,405, incorporated herein in its entirety. Generally, natural or synthetic resin materials, and rosin materials, work well. Prefered amounts of tackifier range from about 1 to about 50 weight percent of the composition. More preferable concentrations range from about 5 to about 25 percent, and most preferable concentrations range from about 10 to about 20 percent, by weight, of the composition.

The resins that can be employed according to the present invention are liquid, semi-solid to solid, complex amorphous materials generally in the form of mixtures of organic compounds having no definite melting point and no tendency to crystallize. Such resins are insoluble in water and can be of vegetable or animal origin, or can be synthetic resins. The resins employed function to provide substantial and improved tackiness of the composition. Suitable tackifiers include, but are not necessarily limited to the resins discussed below. A class of resin components that can be employed as the tackifier composition hereof, are the coumarone-indene resins, such as the para coumarone-indene resins. Generally the coumarone-indene resins which can be employed have a molecular weight which ranges from about 500 to about 5,000. Examples of resins of this type which are available commercially include those materials marketed as 'Picco'-25 and 'Picco'-100.

Another class of resins which can be employed as the tackifier hereof are the terpene resins, including also styrenic modified terpenes. These terpene resins can have a molecular weight range from about 600 to 6,000. Typical commercially available resins of this type are marketed as 'Piccolyte' S-100, as 'Staybelite Ester' #10, which is a glycerol ester of hydrogenated rosin, and as 'Wingtack' 95 which is a polyterpene resin.

Additionally, butadiene-styrene resins having a molecular weight ranging from about 500 to about 5,000 may be used as the tackifier. A typical commercial product of this type is marketed as 'Buton' 100, a liquid butadiene-styrene copolymer resin having a molecular weight of about 2,500. A fourth class of resins which can be employed as the tackifier hereof are the polybutadiene resins having a molecular weight ranging from about 500 to about 5,000. A commercially available product of this type is that marketed as 'Buton' 150, a liquid polybutadiene resin having a molecular weight of about 2,000 to about 2,500.

Another useful class of resins which can be employed as the tackifier are the so-called hydrocarbon resins produced by catalytic polymerization of selected fractions obtained in the refining of petroleum, and having a molecular weight range of about 500 to about 5,000. Examples of such resins are those marketed as 'Piccopale'-100, and as 'Amoco' and 'Velsicol' resins. Similarly, polybutenes obtained from the polymerization of isobutylene may be included as a tackifier.

The tackifier may also include rosin materials, low molecular weight styrene hard resins such as the material marketed as 'Piccolastic' A-75, disproportionated pentaerythritol esters, and copolymers of aromatic and aliphatic monomer systems of the type marketed as 'Velsicol' WX-1232. The rosin that may be employed in the present invention may be gum, wood or tall oil rosin but preferably is tall oil rosin. Also the rosin material may be a modified rosin such as dimerized rosin, hydrogenated rosin, disproportionated rosin, or esters of rosin. Esters can be prepared by esterifying the rosin with polyhydric alcohols containing 2–6 alcohol groups.

Useful tackifiers include aromatic hydrocarbon resins, including those with low softening points such as Piccovar™; and aliphatic, low molecular weight hydrocarbon resins such as Piccopale™ (mentioned above), and those with high softening points such as Piccotac™. Additional useful tackifiers include synthetic polyterpene resins such as Wingtack™, and hydrogenated rosin, glycerol ester resins such as Foral™. These must be regarded only as typical examples, as literally hundreds of logical candidates exist. A more comprehensive listing of tackifiers which can be employed is provided in the TAPPI CA Report #55, February 1975, pages 13–20, inclusive, a publication of the Technical Association of the Pulp and Paper Industry, Atlanta, Ga., which lists well over 200 commercially available tackifier resins.

In use, the compounder generally will want to select an ethylene-based copolymer and a tackifier resin, which will be mutually compatible; chemical similarities, which will indicate compatibility, can be used for guidance. The compounder may also elect to use incompatible systems. Finally, the reverse effect may be sought. For example, where an unusually slippery surface is desired, incorporation of small amounts of a slip aid may prove beneficial.

Plasticizers and Oils

It may further be useful to employ any one or a combination of plasticizing substances in the compositions of the present invention. The use of plasticizers in α-olefin/vinyl or vinylidene substantially random interpolymers is known in the art. For example, U.S. Pat. No. 5,739,200, specifically incorporated herein in its entirety, explains the use of plasticizers in α-olefin/vinyl or vinylidene interpolymers, and lists those plasticizing agents that are particularly useful in compositions containing α-olefin/vinyl or vinylidene interpolymers. Preferred concentrations of plasticizers range from about 0.5 to about 50 percent, by weight. More preferred concentrations range from about 1.0 to about 35 percent by weight, with most preferred concentrations ranging from about 2.0 to about 20 percent, by weight.

Suitable plasticizers which can be employed herein include at least one plasticizer selected from the group consisting of phthalate esters, trimellitate esters, benzoates, aliphatic diesters (including adipates azelates and sebacates), epoxy compounds, phosphate esters, glutarates, polymeric plasticizers (polyesters of glycols and aliphatic dicarboxylic acids) and oils.

Particularly suitable phthalate esters include, for example, dialkyl $C_4$–$C_{18}$ phthalate esters such as diethyl, dibutyl phthalate, diisobutyl phthalate, butyl 2-ethylhexyl phthalate, dioctyl phthalate, diisooctyl phthalate, dinonyl phthalate, diisononyl phthalate, didecyl phthalate, diisodecyl phthalate, diundecyl phthalate, mixed aliphatic esters such as heptyl nonyl phthalate, di(n-hexyl, n-octyl, n-decyl) phthalate (P610), di(n-octyl, n-decyl) phthalate (P810), and aromatic phthalate esters such as diphenyl phthalate ester, or mixed aliphatic-aromatic esters such as benzyl butyl phthalate or any combination thereof and the like.

Particularly suitable trimellitate esters include, for example, tri(2-ethylhexyl) trimellitate, tri(heptyl, nonyl) trimellitate, tri isooctyl trimellitate, tri isodecyl trimellitate, tri(octyl, decyl) trimellitate. Particularly suitable benzoates include, for example, diethylene glycol dibenzoate and dipropylene glycol dibenzoate. Particularly suitable epoxy compounds include, for example, epoxidised vegetable oils such as epoxidised soyabean oil and epoxidised linseed oil.

Particularly suitable phosphate esters include, for example, triaryl, trialkyl, mixed alkyl aryl phosphates such as tributyl phosphate, trioctyl phosphate, tri(2-ethylhexyl) phosphate, tributoxyethyl phosphate, triphenyl phosphate, tricresyl phosphate, isopropylphenyl diphenyl phosphate, t-butylphenyl diphenyl phosphate, 2-ethylhexyl diphenyl phosphate and isodecyl diphenyl phosphate.

Oils may also be used in the compositions of the present invention to manipulate the characteristics of the composition. Commercial oils generally contain a range of components where the composition of the oil is reported as a percentage of napthenic, parafinic and aromatic oil. Suitable oils include virtually any known oil, including naphthenic, parafinic and aromatic oils, further including, for example, mineral oils and natural oils. In general, oils are characterized by their flash point and composition. According to their classification and flash point, one skilled in the art can select the oil or combination of oils that will best achieve the desired characteristics in the compositions of the present invention. Preferred oils include those commercialized under the names Shellflex™ 6371, Shellflex™ 6702, and Shellflex™ 2680.

Additionally, a mixture of plasticizer and processing oil may also be used to effectively achieve the desired properties in the resultant composition according to the present invention. For example, one may combine any processing oil with an epoxidized oil, a polyether, or a polyester to manipulate the characteristics of the composition. Indeed, using a combination of plasticizers and oils may achieve more desirable properties than using either in isolation, depending upon the constituent parts of the interpolymer or polymer blend component of the composition.

Other Additives

Other than tackifiers, plasticizers and oils, other useful additives include antioxidants (e.g., hindered phenols such as, for example, IRGANOX™ 1010), phosphites (e.g., IRGAFOS™ 168)), U. V. stabilizers, cling additives (e.g., PIB), antiblock additives, slip agents, colorants, pigments blowing agents, ignition-resistant additives, tinuvin, polyisobutylene, inorganic fillers, titanium dioxide, iron oxide pigments and the like can also be included in the compositions of the present invention.

The above additives are employed in functional amounts known to those of skill in the art. For example, the amount of antioxidant employed is that amount which prevents the polymer or polymer blend from undergoing oxidation at the temperatures and environment employed during processing, storage, and ultimate end use of the polymers. By preventing oxidation, aging of the product is retarded. The amount of antioxidants is usually in the range of from about 0.01 to about 10, preferably from about 0.05 to about 5, more preferably from about 0.1 to about 2 percent by weight based upon the weight of the polymer or organic component of the composition.

Similarly, the amounts of any of the other enumerated components, as well as additives, are the functional amounts such as the amount to render the polymer or polymer blend antiblocking, to produce the desired amount of filler loading to produce the desired result, to provide the desired color from the colorant or pigment, and the like. Such additives, in particular, can suitably be employed in the range of from about 0.05 to about 50, preferably from about 0.1 to about 35 more preferably from about 0.2 to about 20 percent by weight based upon the weight of the polymer or polymer blend.

A particularly desirable processing aid includes oxidized polyethylene. Oxidized polyethylene is available commercially from, for example, AlliedSignal Chemical under the trade name AC™6. A process-improving amount of oxidized polyethylene may often help to improve the compounding of the compositions of the present invention by lowering the torque or pressure required to compound and extrude the composition without lowering the physical properties of the composition. Generally, the amount of oxidized polyethylene which may be required is from about 1 to about 10, preferably from about 2 to about 5 weight percent of the composition.

Electrically Conductive Substrate

The electrically conductive substrate of the present invention includes any substrate capable of conducting electricity. Such substrates include, for example, wires, filaments, tapes, superconductors, cables, etc., comprised of gold, silver, copper, aluminum, conducting polymers, conducting polymeric compositions etc. One of skill in the art would recognize suitable conductive substrates that are advantageous for the present invention. The term "electrically conductive substrate" is also meant to include those substrates like glass and optical fibers, and the like, that transfer electromagnetic radiation, such as light.

Insulating Composition

The insulating composition of the device of the present invention may comprise a neat polymer, or it may blended with another thermoplastic, provided that the additional thermoplastic material does not adversely affect the desired performance of the device, or it may be optionally be filled. Suitable fillers include those described in application Ser. No. 882,819 filed Jun. 26, 1999 now U.S. Pat. No. 5,973,049, of which a number are ignition-resistant.

The insulating composition may also comprise a water-treeing inhibitor in a functional amount. The choice of inhibitor may vary according to the application in which it is to be employed. Suitable inhibitors usually include talc, calcium carbonate, lead oxide, ethylene vinyl acetate, ethylene butyl acrylate, ethylene ethylacrylate, polypropylene glycol, polyethylene glycol, organosilanes, silicates, and the like.

The amount of inhibitor also varies according to the application. Generally, amount of inhibitor is from about 0.01 to about 20, preferably from about 0.05 to about 15, more preferably from about 0.05 to about 10 weight percent of the insulating composition.

Semi-Conductive Composition

The semi-conductive compositions of the devices of the present invention typically comprise a polymer or polymer blend and a conducting filler to render the composition semi-conducting. The most common fillers for semi-conductive compositions are carbon black and graphite. The amount of filler will vary depending on the type of filler and other components. Generally, the filler will comprise from about 10 to about 55 weight percent of the filled semi-conductive composition. Preferably, the filler will comprise from about 20 to about 45, more preferably from about 30 to about 40, weight percent of the filled semi-conductive composition. If desired, a plurality of neutral wires which are usually made of copper may be embedded in or wrapped around the layer of semi-conducting insulation shielding in the form of a concentric ring around the insulated cable.

Often it is preferable that the semi-conductive composition be strippable. By "strippable" it is meant that the semi-conductive composition have limited adhesion to a layer beneath it, often an insulating layer, so that the semi-conductive composition can be peeled cleanly away (generally after cutting "tramlines" part-way through its thickness) without removing any of the underlying layers. Thus, it is often preferable to add an adhesion-adjusting amount of an adhesion-adjusting additive.

Adhesion-adjusting additives include, for example, waxy aliphatic hydrocarbons (Watanabe et al U.S. Pat. No. 4,993,107); low-molecular weight ethylene homopolymers (Burns Jr U.S. Pat. No. 4,150,193); various silicone compounds (Taniguchi U.S. Pat. No. 4,493,787); chlorosulfonated polyethylene, propylene homopolymers, propylene copolymers, ethylene-propylene rubber, polychloroprene, styrene-butadiene rubber, natural rubber, polyester rubber, and polyurethane rubber (all in Jansson U.S. Pat. No. 4,226,823); and ethylene copolymers such as those described in WO98/21278 published on May 22, 1987. Other thermoplastic materials may be suitably used, in the present invention, to adjust the adhesion. Materials such as polystyrene or low molecular weight polystyrene (as exemplified as Piccolastic™D125, available from Hercules, Inc.), and the like, are suitable.

Often, too, it is preferable that the semi-conductive composition be bonded. By "bonded" it is meant that the semi-conductive composition have excellent adhesion to a layer beneath it, often an insulating layer, so that the semi-conductive composition cannot be easily separated without removing some or any of the underlying layers. Thus, it is often preferable to add an adhesion-adjusting amount of an adhesion-promoting additive. One of skill in the art would recognize and choose from those materials known to promote adhesion to the insulating, or other layers.

Protective Composition or Layer

The protective composition or layer of the devices of the present invention typically comprise a polymer or polymer blend which are suitable to protect the device from, for example, heat, light, air, moisture, cold, etc. The protective layer may be comprised of any suitable material. Suitable materials include the interpolymers of the present invention, jacketing materials normally employed in power cables and electrical devices such as neoprene, polyvinyl chloride (PVC), polyethylene, as well as mixtures of the aforementioned materials, or other suitable materials.

Preparing the Compositions for Use in the Electrical Device

All of the components of the compositions utilized in the present invention are usually blended or compounded together prior to their introduction into an extrusion device from which they are to be extruded onto an electrical conductor. The interpolymer and the other additives and fillers may be blended together by any of the techniques used in the art to blend and compound such mixtures into homogeneous masses. For instance, the components may be fluxed on a variety of apparatuses including multi-roll mills, screw mills, continuous mixers, compounding extruders and Banbury mixers, and the like.

After the various components of the composition to be utilized are uniformly admixed and blended together, they are further processed to fabricate the devices of the present invention. Prior art methods for fabricating polymer insulated cable and wire are well known, and fabrication of the device of the present invention may generally be accomplished by any of the various extrusion methods. In a typical extrusion method, an optionally heated conducting core to be coated is pulled through a heated extrusion die, generally a cross-head die, in which a layer of melted polymer is applied to the conducting core. Upon exiting the die, the conducting core with the applied polymer layer is passed through a cooling section, generally an elongated cooling bath, to harden. Multiple polymer layers may be applied by consecutive extrusion steps, in which an additional layer is added in each step, or with the proper type of die, multiple polymer layers may be applied simultaneously.

The semi-conductive conductor shielding layer, the insulation layer and semi-conducting insulation shielding layer shown in FIG. 1, can each be formed in the art by what is known as a two pass operation or by a single pass triple extrusion process. The two pass operation is one in which the semi-conductive conductor shielding layer and the insulation layer are first extruded in tandem and crosslinked prior to extrusion and crosslinking of the semi-conductive insulation shielding layer. In the single pass, triple extrusion operation (sometimes a tandem extrusion when the semi-conductive conductor shielding layer is first extruded followed by the extrusion of the insulation layer and the semi-conductive insulation shielding layer in the dual extrusion head) the semi-conductive conductor shielding layer, the insulation layer, and the overlying semi-conductive insulation shielding layer are extruded in a common extrusion head and cured (crosslinked) simultaneously in a single operation to minimize manufacturing steps and contamination between layers. The single pass, triple extrusion method is preferred. However, the simultaneous curing of the insulation layer and its overlying semi-conductive insulation shielding layer of the triple extrusion method in general makes the shielding layer more fully bonded to the insulation than it might be if it were made as a result of a two pass operation.

Electrically Conductive Device

The devices of the present invention may take on any form that is suitable for its intended use. In its simplest form, the device comprises an electrically conductive substrate surrounded by an interpolymer as described above. It is often convenient in such cases for the interpolymer to function as an insulation layer and as such may be admixed with other polymers such as those described above. Such devices may take the form of a cable wherein the electrically conductive substrate extends longitudinally and has a coating comprising an interpolymer around the substrate. Such devices may be useful as, for example, cords in household appliances, computers, and other lower voltage apparatuses. Other devices, where the interpolymer covers the conducting member, such as 2–3 prong plug assemblies, electrical sockets, multi-wire cable couplers, unions, joints, etc., are also included in the present invention.

Other devices of the present invention include devices, which have a plurality of conductors within a sheath. The interstices between conductors may be filled with a composition comprising one or more substantially random interpolymers of the present invention. Such devices include, for example, telecommunication cables and wires.

Further devices include those, which utilize conductive substrates such as glass and optical fibers, and the like, to transfer electromagnetic radiation, such as light. These devices are collectively referred to as fiber optic cables.

Further Embodiments

FIG. 1 is a cross-sectional view of a typical medium or high voltage power cable, showing a conductor core (1), comprising a multiplicity of conducting substrates (2), a semi-conducting conductor shielding layer (3), an insulation layer (4), a semi-conducting insulation shielding layer (5), a neutral layer (6) and a jacket or protective layer (7). While the present invention is of great advantage in high and medium voltage applications, where extended service life is most desired, it is also useful in low voltage applications which typically comprise only a conducting substrate surrounded by insulation.

EXAMPLES

Preparation of the Ethylene/Styrene Interpolymers (ESI's) 1–12

Preparation of Catalyst A; (dimethyl[N-(1,1-dimethylethyl)-1,1-dimethyl-1-[(1,2,3,4,5-η)-1,5,6,7-tetrahydro-3-phenyl-s-indacen-1-yl]silanaminato(2-)-N]-titanium)

1) Preparation of 3,5,6,7-Tetrahydro-s-Hydrindacen-1(2H)-one

Indan (94.00 g, 0.7954 moles) and 3-chloropropionyl chloride (100.99 g, 0.7954 moles) were stirred in $CH_2Cl_2$ (300 mL) at 0° C. as $AlCl_3$ (130.00 g, 0.9750 moles) was added slowly under a nitrogen flow. The mixture was then allowed to stir at room temperature for 2 hours. The volatiles were then removed. The mixture was then cooled to 0° C. and concentrated $H_2SO_4$ (500 mL) slowly added. The forming solid had to be frequently broken up with a spatula as stirring was lost early in this step. The mixture was then left under nitrogen overnight at room temperature. The mixture was then heated until the temperature readings reached 90° C. These conditions were maintained for 2 hours during which a spatula was periodically used to stir the mixture. After the reaction period crushed ice was placed in the mixture and moved around. The mixture was then transferred to a beaker and washed intermittently with $H_2O$ and diethylether and then the fractions filtered and combined. The mixture was washed with $H_2O$ (2×200 mL). The organic layer was then separated and the volatiles removed. The desired product was then isolated via recrystallization from hexane at 0° C. as pale yellow crystals (22.36 g, 16.3% yield).

$^1$H NMR ($CDCl_3$): d2.04–2.19 (m, 2 H), 2.65 (t, $^3J$HH=5.7 Hz, 2 H), 2.84–3.0 (m, 4 H), 3.03 (t, $^3J$HH=5.5 Hz, 2 H), 7.26 (s, 1 H), 7.53 (s, 1 H).

$^{13}$C NMR ($CDCl_3$): d25.71, 26.01, 32.19, 33.24, 36.93, 118.90, 122.16, 135.88, 144.06, 152.89, 154.36, 206.50.

GC-MS: Calculated for $C_{12}H_{12}O$ 172.09, found 172.05.

2) Preparation of 1,2,3,5-Tetrahydro-7-phenyl-s-indacen 3,5,6,7-Tetrahydro-s-Hydrindacen-1(2H)-one (12.00 g, 0.06967 moles) was stirred in diethylether (200 mL) at 0° C. as PhMgBr (0.105 moles, 35.00 mL of 3.0 M solution in diethylether) was added slowly. This mixture was then allowed to stir overnight at room temperature. After the reaction period the mixture was quenched by pouring over ice. The mixture was then acidified (pH=1) with HCl and stirred vigorously for 2 hours. The organic layer was then separated and washed with $H_2O$ (2×100 mL) and then dried over $MgSO_4$. Filtration followed by the removal of the volatiles resulted in the isolation of the desired product as a dark oil (14.68 g, 90.3% yield).

$^1$H NMR ($CDCl_3$): d2.0–2.2 (m, 2 H), 2.8–3.1 (m, 4 H), 6.54 (s, 1H), 7.2–7.6 (m, 7 H).

GC-MS: Calculated for $C_{18}H_{16}$ 232.13, found 232.05.

3) Preparation of 1,2,3,5-Tetrahydro-7-phenyl-s-indacene, dilithium salt 1,2,3,5-Tetrahydro-7-phenyl-s-indacen (14.68 g, 0.06291 moles) was stirred in hexane (150 mL) as nBuLi (0.080 moles, 40.00 mL of 2.0 M solution in cyclohexane) was slowly added. This mixture was then allowed to stir overnight. After the reaction period the solid was collected via suction filtration as a yellow solid which was washed with hexane, dried under vacuum, and used without further purification or analysis (12.2075 g, 81.1% yield).

4) Preparation of Chlorodimethyl(1,5,6,7-tetrahydro-3-phenyl-s-indacen-1-yl)silane 1,2,3,5-Tetrahydro-7-phenyl-s-indacene, dilithium salt (12.2075 g, 0.05102 moles) in THF (50 mL) was added dropwise to a solution of $Me_2SiCl_2$ (19.5010 g, 0.1511 moles) in THF (100 mL) at 0° C. This mixture was then allowed to stir at room temperature overnight. After the reaction period the volatiles were removed and the residue extracted and filtered using hexane. The removal of the hexane resulted in the isolation of the desired product as a yellow oil (15.1492 g, 91.1% yield).

$^1$H NMR ($CDCl_3$): d0.33 (s, 3 H), 0.38 (s, 3 H), 2.20 (p, $^3J$HH=7.5 Hz, 2 H), 2.9–3.1 (m, 4 H), 3.84 (s, 1 H), 6.69 (d, $^3J$HH=2.8 Hz, 1 H), 7.3–7.6 (m, 7 H), 7.68 (d, $^3J$HH=7.4 Hz, 2 H).

$^{13}$C NMR ($CDCl_3$): d0.24, 0.38, 26.28, 33.05, 33.18, 46.13, 116.42, 119.71, 127.51, 128.33, 128.64, 129.56, 136.51, 141.31, 141.86, 142.17, 142.41, 144.62.

GC-MS: Calculated for $C_{20}H_{21}ClSi$ 324.11, found 324.05.

5) Preparation of N-(1,1-Dimethylethyl)-1,1-dimethyl-1-(1,5,6,7-tetrahydro-3-phenyl-s-indacen-1-yl)silanamine Chlorodimethyl(1,5,6,7-tetrahydro-3-phenyl-s-indacen-1-yl)silane (10.8277 g, 0.03322 moles) was stirred in hexane (150 mL) as $NEt_3$ (3.5123 g, 0.03471 moles) and t-butylamine (2.6074 g, 0.03565 moles) were added. This mixture was allowed to stir for 24 hours. After the reaction period the mixture was filtered and the volatiles removed resulting in the isolation of the desired product as a thick red-yellow oil (10.6551 g, 88.7% yield).

$^1$H NMR ($CDCl_3$): d0.02 (s, 3 H), 0.04 (s, 3 H), 1.27 (s, 9 H), 2.16 (p, $^3J$HH=7.2 Hz, 2 H), 2.9–3.0 (m, 4 H), 3.68 (s, 1 H), 6.69 (s, 1 H), 7.3–7.5 (m, 4 H), 7.63 (d, $^3J$HH=7.4 Hz, 2 H).

$^{13}$C NMR ($CDCl_3$): d–0.32, –0.09, 26.28, 33.39, 34.11, 46.46, 47.54, 49.81, 115.80, 119.30, 126.92, 127.89, 128.46, 132.99, 137.30, 140.20, 140.81, 141.64, 142.08, 144.83.

6) Preparation of N-(1,1-Dimethylethyl)-1,1-dimethyl-1-(1,5,6,7-tetrahydro-3-phenyl-s-indacen-1-yl) silanamine, dilithium salt N-(1,1-Dimethylethyl)-1,1-dimethyl-1-(1,5,6,7-tetrahydro-3-phenyl-s-indacen-1-yl)silanamine (10.6551 g, 0.02947 moles) was stirred in hexane (100 mL) as nBuLi (0.070 moles, 35.00 mL of 2.0 M solution in cyclohexane) was added slowly. This mixture was then allowed to stir overnight during which time no salts crashed out of the dark red solution. After the reaction period the volatiles were removed and the residue quickly washed with hexane (2×50 mL). The dark red residue was then pumped dry and used without further purification or analysis (9.6517 g, 87.7% yield).

7) Preparation of Dichloro[N-(1,1-dimethylethyl)-1,1-dimethyl-1-[(1,2,3,4,5-η)-1,5,6,7-tetrahydro-3-phenyl-s-indacen-1-yl]silanaminato(2-)-N]titanium N-(1,1-Dimethylethyl)-1,1-dimethyl-1-(1,5,6,7-tetrahydro-3-phenyl-s-indacen-1-yl)silanamine, dilithium salt (4.5355 g, 0.01214 moles) in THF (50 mL) was added dropwise to a slurry of $TiCl_3(THF)_3$ (4.5005 g, 0.01214 moles) in THF (100 mL). This mixture was allowed to stir for 2 hours. $PbCl_2$ (1.7136 g, 0.006162 moles) was then added and the mixture allowed to stir for an additional hour. After the reaction period the volatiles were removed and the residue extracted and filtered using toluene. Removal of the toluene resulted in the isolation of a dark residue. This residue was then slurried in hexane and cooled to 0° C. The desired product was then isolated via filtration as a red-brown crystalline solid (2.5280 g, 43.5% yield).

$^1$H NMR ($CDCl_3$): d0.71 (s, 3 H), 0.97 (s, 3 H), 1.37 (s, 9 H), 2.0–2.2 (m, 2 H), 2.9–3.2 (m, 4 H), 6.62 (s, 1 H), 7.35–7.45 (m, 1 H), 7.50 (t, $^3J$HH=7.8 Hz, 2 H), 7.57 (s, 1 H), 7.70 (d, $^3J$HH=7.1 Hz, 2 H), 7.78 (s, 1 H).

$^1$H NMR ($C_6D_6$): d0.44 (s, 3 H), 0.68 (s, 3 H), 1.35 (s, 9 H), 1.6–1.9 (m, 2 H), 2.5–3.9 (m, 4 H), 6.65 (s, 1 H), 7.1–7.2 (m, 1 H), 7.24 (t, $^3J$HH=7.1 Hz, 2 H), 7.61 (s, 1 H), 7.69 (s, 1 H), 7.77–7.8 (m, 2 H).

$^{13}$C NMR ($CDCl_3$): d1.29, 3.89, 26.47, 32.62, 32.84, 32.92, 63.16, 98.25, 118.70, 121.75, 125.62, 128.46, 128.55, 128.79, 129.01, 134.11, 134.53, 136.04, 146.15, 148.93.

$^{13}$C NMR ($C_6D_6$): d0.90, 3.57, 26.46, 32.56, 32.78, 62.88, 98.14, 119.19, 121.97, 125.84, 127.15, 128.83, 129.03, 129.55, 134.57, 135.04, 136.41, 136.51, 147.24, 148.96.

8) Preparation of Dimethyl[N-(1,1-dimethylethyl)-1,1-dimethyl-1-[(1,2,3,4,5-η)-1,5,6,7-tetrahydro-3-phenyl-s-indacen-1-yl]silanaminato(2-)-N]titanium Dichloro[N-(1,1-dimethylethyl)-1,1-dimethyl-1-[(1,2,3,4,5-η)-1,5,6,7-tetrahydro-3-phenyl-s-indacen-1-yl]

silanaminato(2-)-N]titanium (0.4970 g, 0.001039 moles) was stirred in diethylether (50 mL) as MeMgBr (0.0021 moles, 0.70 mL of 3.0 M solution in diethylether) was added slowly. This mixture was then stirred for 1 hour. After the reaction period the volatiles were removed and the residue extracted and filtered using hexane. Removal of the hexane resulted in the isolation of the desired product as a golden yellow solid (0.4546 g, 66.7% yield).

$^1$H NMR ($C_6D_6$): d0.071 (s, 3 H), 0.49 (s, 3 H), 0.70 (s, 3 H), 0.73 (s, 3 H), 1.49 (s, 9 H), 1.7–1.8 (m, 2 H), 2.5–2.8 (m, 4 H), 6.41 (s, 1 H), 7.29 (t, $^3$JHH=7.4 Hz, 2 H), 7.48 (s, 1 H), 7.72 (d, $^3$JHH=7.4 Hz, 2 H), 7.92 (s, 1 H).

$^{13}$C NMR ($C_6D_6$): d2.19, 4.61, 27.12, 32.86, 33.00, 34.73, 58.68, 58.82, 118.62, 121.98, 124.26, 127.32, 128.63, 128.98, 131.23, 134.39, 136.38, 143.19, 144.85.

Preparation of bis(hydrogenated-tallowalkyl)methylamine) Cocatalyst C

Methylcyclohexane (1200 mL) was placed in a 2 L cylindrical flask. While stirring, 104 g, ground to a granular form of bis(hydrogenated-tallowalkyl)methylamine (ARMEEN® M2HT available from Akzo Chemical,) was added to the flask and stirred until completely dissolved. Aqueous HCl (1M, 200 mL) was added to the flask, and the mixture was stirred for 30 minutes. A white precipitate formed immediately. At the end of this time, $LiB(C_6F_5)_4.Et_2O.3$ LiCl (Mw=887.3; 177.4 g) was added to the flask. The solution began to turn milky white. The flask was equipped with a 6" Vigreux column topped with a distillation apparatus and the mixture was heated (140° C. external wall temperature). A mixture of ether and methylcyclohexane was distilled from the flask. The two-phase solution was now only slightly hazy. The mixture was allowed to cool to room temperature, and the contents were placed in a 4 L separatory funnel. The aqueous layer was removed and discarded, and the organic layer was washed twice with $H_2O$ and the aqueous layers again discarded. The $H_2O$ saturated methylcyclohexane solutions were measured to contain 0.48 wt percent diethyl ether ($Et_2O$).

The solution (600 mL) was transferred into a 1 L flask, sparged thoroughly with nitrogen, and transferred into an inert atmosphere glove box. The solution was passed through a column (1" diameter, 6" height) containing 13× molecular sieves. This reduced the level of $Et_2O$ from 0.48 wt percent to 0.28 wt percent. The material was then stirred over fresh 13× sieves (20 g) for four hours. The $Et_2O$ level was then measured to be 0.19 wt percent. The mixture was then stirred overnight, resulting in a further reduction in $Et_2O$ level to approximately 40 ppm. The mixture was filtered using a funnel equipped with a glass frit having a pore size of 10–15 $\mu$m to give a clear solution (the molecular sieves were rinsed with additional dry methylcyclohexane). The concentration was measured by gravimetric analysis yielding a value of 16.7 wt percent.

Polymerization

ESI #'s 1–3 were prepared in a 6 gallon (22.7 L), oil jacketed, Autoclave continuously stirred tank reactor (CSTR). A magnetically coupled agitator with Lightning A-320 impellers provided the mixing. The reactor ran liquid full at 475 psig (3,275 kPa). Process flow was in at the bottom and out of the top. Heat transfer oil was circulated through the jacket of the reactor to remove some of the heat of reaction. At the exit of the reactor was a MicroMotion™ flow meter that measured flow and solution density. All lines on the exit of the reactor were traced with 50 psi (344.7 kPa) steam and insulated.

Toluene solvent was supplied to the reactor at 30 psig (207 kPa). The feed to the reactor was measured by a MicroMotion™ mass flow meter. A variable speed diaphragm pump controlled the feed rate. At the discharge of the solvent pump, a side stream was taken to provide flush flows for the catalyst injection line (1 lb/hr (0.45 kg/hr)) and the reactor agitator (0.75 lb/hr (0.34 kg/hr)). These flows were measured by differential pressure flow meters and controlled by manual adjustment of micro-flow needle valves. Uninhibited styrene monomer was supplied to the reactor at 30 psig (207 kPa). The feed to the reactor was measured by a MicroMotion™ mass flow meter. A variable speed diaphragm pump controlled the feed rate. The styrene stream was mixed with the remaining solvent stream.

Ethylene was supplied to the reactor at 600 psig (4,137 kPa). The ethylene stream was measured by a MicroMotion™ mass flow meter just prior to the Research valve controlling flow. A Brooks flow meter/controller was used to deliver hydrogen into the ethylene stream at the outlet of the ethylene control valve. The ethylene/hydrogen mixture combines with the solvent/styrene stream at ambient temperature. The temperature of the solvent/monomer as it enters the reactor was dropped to ~5° C. by an exchanger with −5° C. glycol on the jacket. This stream entered the bottom of the reactor.

The three component catalyst system and its solvent flush also entered the reactor at the bottom but through a different port than the monomer stream. Preparation of the catalyst components took place in an inert atmosphere glove box. The diluted components were put in nitrogen padded cylinders and charged to the catalyst run tanks in the process area. From these run tanks the catalyst was pressured up with piston pumps and the flow was measured with MicroMotion™ mass flow meters. These streams combine with each other and the catalyst flush solvent just prior to entry through a single injection line into the reactor.

Polymerization was stopped with the addition of catalyst kill (water mixed with solvent) into the reactor product line after the MicroMotion™ flow meter measuring the solution density. Other polymer additives can be added with the catalyst kill. A static mixer in the line provided dispersion of the catalyst kill and additives in the reactor effluent stream. This stream next entered post reactor heaters that provide additional energy for the solvent removal flash. This flash occurred as the effluent exited the post reactor heater and the pressure was dropped from 475 psig (3,275 kPa) down to ~250 mm of pressure absolute at the reactor pressure control valve. This flashed polymer entered a hot oil jacketed devolatilizer. Approximately 85 percent of the volatiles were removed from the polymer in the devolatilizer. The volatiles exited the top of the devolatilizer. The stream was condensed with a glycol jacketed exchanger and entered the suction of a vacuum pump and was discharged to a glycol jacket solvent and styrene/ethylene separation vessel. Solvent and styrene were removed from the bottom of the vessel and ethylene from the top. The ethylene stream was measured with a MicroMotion mass flow meter and analyzed for composition. The measurement of vented ethylene plus a calculation of the dissolved gasses in the solvent/styrene stream were used to calculate the ethylene conversion. The polymer separated in the devolatilizer was pumped out with a gear pump to a ZSK-30 devolatilizing vacuum extruder. The dry polymer exits the extruder as a single strand. This strand was cooled as it was pulled through a water bath. The excess water was blown from the strand with air and the strand was chopped into pellets with a strand chopper.

ESI #'s 4 –12 were prepared in a continuously operating loop reactor (36.8 gal). An Ingersoll-Dresser twin screw pump provided the mixing. The reactor ran liquid full at 475 psig (3,275 kPa) with a residence time of approximately 25 minutes. Raw materials and catalyst/cocatalyst flows were fed into the suction of the twin screw pump through injectors and Kenics static mixers. The twin screw pump discharged into a 2" diameter line which supplied two Chemineer-Kenics 10-68 Type BEM Multi-Tube heat exchangers in series. The tubes of these exchangers contained twisted tapes to increase heat transfer. Upon exiting the last exchanger, loop flow returned through the injectors and static mixers to the suction of the pump. Heat transfer oil was circulated through the exchangers' jacket to control the loop temperature probe located just prior to the first exchanger. The exit stream of the loop reactor was taken off between the two exchangers. The flow and solution density of the exit stream was measured by a MicroMotion™ mass flow meter.

Solvent feed to the reactor was supplied by two different sources. A fresh stream of toluene from an 8480-S-E Pulsafeeder™ diaphragm pump with rates measured by a MicroMotion™ flowmeter was used to provide flush flow for the reactor seals (20 lb/hr (9.1 kg/hr). Recycle solvent was mixed with uninhibited styrene monomer on the suction side of five 8480-5-E Pulsafeeder™ diaphragm pumps in parallel. These five Pulsafeeder™ pumps supplied solvent and styrene to the reactor at 650 psig (4,583 kPa). Fresh styrene flow was measured by a MicroMotion™ flowmeter, and total recycle solvent/styrene flow was measured by a separate MicroMotion™ flowmeter. Ethylene was supplied to the reactor at 687 psig (4,838 kPa). The ethylene stream was measured by a MicroMotion™ mass flowmeter. A Brooks flowmeter/controller was used to deliver hydrogen into the ethylene stream at the outlet of the ethylene control valve.

The ethylene/hydrogen mixture combined with the solvent/styrene stream at ambient temperature. The temperature of the entire feed stream as it entered the reactor loop was lowered to 2° C. by an exchanger with −10° C. glycol on the jacket. Preparation of the three catalyst components took place in three separate tanks. Fresh solvent and concentrated catalyst/cocatalyst premix were added and mixed into their respective run tanks and fed into the reactor via variable speed 680-S-AEN7 Pulsafeeder™ diaphragm pumps. As previously explained, the three component catalyst system entered the reactor loop through an injector and static mixer into the suction side of the twin screw pump. The raw material feed stream was also fed into the reactor loop through an injector and static mixer downstream of the catalyst injection point but upstream of the twin screw pump suction.

Polymerization was stopped with the addition of catalyst kill (water mixed with solvent) into the reactor product line after the MicroMotion™ flow meter measuring the solution density. A static mixer in the line provided dispersion of the catalyst kill and additives in the reactor effluent stream. This stream next entered post reactor heaters that provided additional energy for the solvent removal flash. This flash occurred as the effluent exited the post reactor heater and the pressure was dropped from 475 psig (3,275 kPa) down to 450 mmHg (60 kPa) of absolute pressure at the reactor pressure control valve.

This flashed polymer entered the first of two hot oil jacketed devolatilizers. The volatiles flashing from the first devolatilizer were condensed with a glycol jacketed exchanger, passed through the suction of a vacuum pump, and were discharged to the solvent and styrene/ethylene separation vessel. Solvent and styrene were removed from the bottom of this vessel as recycle solvent while ethylene exhausted from the top. The ethylene stream was measured with a MicroMotion™ mass flowmeter. The measurement of vented ethylene plus a calculation of the dissolved gases in the solvent/styrene stream were used to calculate the ethylene conversion. The polymer and remaining solvent separated in the devolatilizer was pumped with a gear pump to a second devolatilizer. The pressure in the second devolatilizer was operated at 5 mmHg (0.7 kPa) absolute pressure to flash the remaining solvent. This solvent was condensed in a glycol heat exchanger, pumped through another vacuum pump, and exported to a waste tank for disposal. The dry polymer (<1000 ppm total volatiles) was pumped with a gear pump to an underwater pelletizer with 6-hole die, pelletized, spin-dried, and collected in 1000 lb boxes.

The various catalysts, co-catalysts and process conditions used to prepare the various individual ethylene styrene interpolymers ESI #'s 4–12 are summarized in Table 1 and their properties in Table 2.

The molecular weight of the polymer compositions used in the present invention is conveniently indicated using a melt index measurement according to ASTM D-1238, Condition 190° C./2.16 kg (formally known as "Condition (E)" and also known as $I_2$).

Another useful method to indicate or determine the melt flow properties of the substantially random interpolymers used in the present invention is the Gottfert melt index (G#, $cm^3$/10 min) which is obtained in a similar fashion as for melt index ($I_2$) using the ASTM D1238 procedure for automated plastometers, with the melt density set to 0.7632, the melt density of polyethylene at 190° C.

The relationship of melt density to styrene content for ethylene-styrene interpolymers was measured, as a function of total styrene content, at 190° C. for a range of 29.8 percent to 81.8 percent by weight styrene interpolymer. Atactic polystyrene levels in these samples were typically 10 percent or less. The influence of the atactic polystyrene was assumed to be minimal because of the low levels. Also, the melt density of atactic polystyrene and the melt densities of the samples with high total styrene are very similar. The method used to determine the melt density employed a Gottfert melt index machine with a melt density parameter set to 0.7632, and the collection of melt strands as a function of time while the $I_2$ weight was in force. The weight and time for each melt strand was recorded and normalized to yield the mass in grams per 10 minutes. The instrument's calculated $I_2$ melt index value was also recorded. The equation used to calculate the actual melt density is;

$$\delta=\delta_{0.7632}\times I_2/I_{2\ \text{Gottfert}}$$

where $\delta_{0.7632}$=0.7632 and $I_2$ Gottfert=displayed melt index.

A linear least squares fit of calculated melt density versus total styrene content leads to an equation with a correlation coefficient of 0.91 for the following equation:

$$\delta=0.00299\times S+0.723$$

where S=weight percentage of styrene in the polymer. The relationship of total styrene to melt density can be used to determine an actual melt index value, using these equations if the styrene content is known.

So for a polymer that is 73% total styrene content with a measured melt flow (the "Gottfert number"), the calculation becomes:

$$\delta=0.00299*73+0.723=0.9412$$

where 0.9412/0.7632=$I_2$/G# (measured)=1.23

The density of the substantially random interpolymers used in the present invention was determined in accordance with ASTM D-792. The samples are annealed at ambient conditions for 24 hours before the measurement is taken.

Interpolymer styrene content and atactic polystyrene concentration were determined using proton nuclear magnetic resonance ($^1$H N.M.R). All proton NMR samples were prepared in 1, 1, 2, 2-tetrachloroethane-$d_2$ (TCE-$d_2$). The resulting solutions were 1.6–3.2 percent polymer by weight. Melt index ($I_2$) was used as a guide for determining sample concentration. Thus when the $I_2$ was greater than 2 g/10 min, 40 mg of interpolymer was used; with an $I_2$ between 1.5 and 2 g/10 min, 30 mg of interpolymer was used; and when the $I_2$ was less than 1.5 g/10 min, 20 mg of interpolymer was used. The interpolymers were weighed directly into 5 mm sample tubes. A 0.75 mL aliquot of TCE-$d_2$ was added by syringe and the tube was capped with a tight-fitting polyethylene cap. The samples were heated in a water bath at 85° C. to soften the interpolymer. To provide mixing, the capped samples were occasionally brought to reflux using a heat gun.

Proton NMR spectra were accumulated on a Varian VXR 300 with the sample probe at 80° C., and referenced to the residual protons of TCE-$d_2$ at 5.99 ppm. The delay times were varied between 1 second, and data was collected in triplicate on each sample. The following instrumental conditions were used for analysis of the interpolymer samples:

Varian VXR-300, standard $^1$H:
Sweep Width, 5000 Hz
Acquisition Time, 3.002 sec
Pulse Width, 8 lsec
Frequency, 300 MHz
Delay, 1 sec
Transients, 16

The total analysis time per sample was about 10 minutes.

Initially, a $^1$H NMR spectrum for a sample of the polystyrene, Styron™ 680 (available form the Dow Chemical Company, Midland, Mich.) was acquired with a delay time of one second. The protons were "labeled": b, branch; a, alpha; o, ortho; m, meta; p, para, as shown:

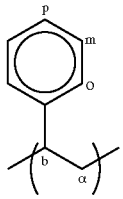

Integrals were measured around the protons labeled above; the 'A' designates aPS. Integral $A_{7.1}$ (aromatic, around 7.1 ppm) is believed to be the three ortho/para protons; and integral $A_{6.6}$ (aromatic, around 6.6 ppm) the two meta protons. The two aliphatic protons labeled a resonate at 1.5 ppm; and the single proton labeled b is at 1.9 ppm. The aliphatic region was integrated from about 0.8 to 2.5 ppm and is referred to as $A_{a1}$. The theoretical ratio for $A_{7.1}$: $A_{6.6}$: $A_{a1}$ is 3:2:3, or 1.5:1:1.5, and correlated very well with the observed ratios for the Styron™ 680 sample for several delay times of 1 second. The ratio calculations used to check the integration and verify peak assignments were performed by dividing the appropriate integral by the integral $A_{6.6}$ Ratio $A_r$ is $A_{7.1}/A_{6.6}$.

Region $A_{6.6}$ was assigned the value of 1. Ratio A1 is integral $A_{a1}/A_{6.6}$. All spectra collected have the expected 1.5:1:1.5 integration ratio of (o+p):m:(α+b). The ratio of aromatic to aliphatic protons is 5 to 3. An aliphatic ratio of 2 to 1 is predicted based on the protons labeled a and b respectively in FIG. 1. This ratio was also observed when the two aliphatic peaks were integrated separately.

For the ethylene/styrene interpolymers, the $^1$H NMR spectra using a delay time of one second, had integrals $C_{7.1}$, $C_{6.6}$, and $C_{a1}$ defined, such that the integration of the peak at 7.1 ppm included all the aromatic protons of the copolymer as well as the o & p protons of aPS. Likewise, integration of the aliphatic region $C_{a1}$ in the spectrum of the interpolymers included aliphatic protons from both the aPS and the interpolymer with no clear baseline resolved signal from either polymer. The integral of the peak at 6.6 ppm $C_{6.6}$ is resolved from the other aromatic signals and it is believed to be due solely to the aPS homopolymer (probably the meta protons). (The peak assignment for atactic polystyrene at 6.6 ppm (integral $A_{6.6}$) was made based upon comparison to the authentic sample Styron™ 680.) This is a reasonable assumption since, at very low levels of atactic polystyrene, only a very weak signal is observed here. Therefore, the phenyl protons of the copolymer must not contribute to this signal. With this assumption, integral $A_{6.6}$ becomes the basis for quantitatively determining the aPS content.

The following equations were then used to determine the degree of styrene incorporation in the ethylene/styrene interpolymer samples:

$$(C\ \text{Phenyl})=C_{7.1}+A_{7.1}-(1.5\times A_{6.6})$$

$$(C\ \text{Aliphatic})=C_{a1}-(15\times A_{6.6})$$

$$s_c=(C\ \text{Phenyl})/5$$

$$e_c=(C\ \text{Aliphatic}-(3\times s_c))/4$$

$$E=e_c/(e_c+s_c)$$

$$S_c=s_c/(e_c+s_c)$$

and the following equations were used to calculate the mole percent ethylene and styrene in the interpolymers:

$$\text{Wt \% } E=\frac{E*28}{(E*28)+(S_c*104)}(100)\text{ and}$$

$$\text{Wt \% } S=\frac{S_c*104}{(E*28)+(S_c*104)}(100)$$

where: $s_c$ and $e_c$ are styrene and ethylene proton fractions in the interpolymer, respectively, and $S_c$ and E are mole fractions of styrene monomer and ethylene monomer in the interpolymer, respectively.

The weight percent of aPS in the interpolymers was then determined by the following equation:

$$\text{Wt \% } aPS=\frac{(\text{Wt \% } S)*\left(\frac{A_{6.6}}{\frac{2}{S_c}}\right)}{100+\left[(\text{Wt \% } S)*\left(\frac{A_{6.6}}{\frac{2}{S_c}}\right)\right]}*100$$

The total styrene content was also determined by quantitative Fourier Transform Infrared spectroscopy (FTIR).

TABLE 1

Preparation Conditions for ESI #'s 1–12

| ESI # | Reactor Temp ° C. | Solvent Flow lb/hr | Ethylene Flow lb/hr | Hydrogen Flow sccm | Styrene Flow lb/hr | Ethylene Conversion % | B/Ti Ratio | MMAO[e]/Ti Ratio | Catalyst | Co-Catalyst |
|---|---|---|---|---|---|---|---|---|---|---|
| ESI 1 | 92.7 | 34.81 | 3.12 | 16 | 5.4 | 95.28 | 1.25 | 7.0 | A | C |
| ESI 2 | 109.8 | 12.00 | 2.34 | 2.8 | 13 | 85.41 | 1.25 | 12 | B | D |
| ESI 4 | 100.1 | 35.02 | 4 | 20 | 2.7 | 92.45 | 3.00 | 5 | B | C |
| ESI 4 | 110 | 400 | 66 | 241 | 30 | 95 | 5.3 | 9.0 | B | C |
| ESI 5 | 102 | 446 | 68 | 420 | 45 | 96 | 5.0 | 10.0 | B | C |
| ESI 6 | 111.6 | 397 | 66 | 421 | 35 | 95 | 5.3 | 6.0 | B | C |
| ESI 7 | 130.5 | 31.00 | 4.2 | 28 | 0.6 | 92.61 | 3 | 4 | B | C |
| ESI 8 | 110.1 | 442 | 66 | 275 | 38 | 95 | 4.0 | 7.0 | B | C |
| ESI 9 | 115 | 553 | 108 | 278 | 62 | 96 | 6.0 | 6.0 | B | C |
| ESI 10 | 100 | 430 | 54 | 2001 | 30 | 95 | 4.0 | 6.0 | B | C |
| ESI 11 | 100 | 380 | 65 | 673 | 59 | 94 | 6.0 | 16.0 | B | C |
| ESI 12 | 83 | 298 | 44 | 100 | 95 | 94 | 6.0 | 15.0 | B | C |

a Catalyst A is dimethyl[N-(1,1-dimethylethyl)-1,1-dimethyl-1-[(1,2,3,4,5-η)-1,5,6,7-tetrahydro-3-phenyl-s-indacen-1-yl]silanaminato(2-)-N]-titanium.
b Catalyst Bis (t-butylamido)dimethyl(tetramethylcyclopentadienyl)silane-titanium (II) 1,3-pentadiene prepared as in U.S. Pat. No. 5,556,928, Ex. 17.)
c Cocatalyst C is tris(pentafluorophenyl)borane, (CAS# 001109-15-5),.
d Cocatalyst D is bis-hydrogenated tallowalkyl methylammonium tetrakis (pentafluorophenyl)borate
e a modified methylaluminoxane commercially available from Akzo Nobel as MMAO-3A (CAS# 146905-79-5).

TABLE 2

Properties of ESI #'s 1–12.

| ESI # | Copolymer Styrene (wt. %) | Copolymer Styrene (mol. %) | Atactic Polystyrene (wt %) | Melt Index $I_2$ (g/10 min) |
|---|---|---|---|---|
| ESI 1 | 40.3 | 15.4 | 0.5 | N/A |
| ESI 2 | 35.9 | 13.1 | 21.6 | N/A |
| ESI 3 | 30.1 | 10.4 | 4.0 | N/A |
| ESI 4 | 29.3 | 10.1 | 0.2 | 1.0 |
| ESI 5 | 34.7 | 12.5 | 0.1 | 1.0 |
| ESI 6 | 29.4 | 10.1 | 0.7 | 1.10 |
| ESI 7 | 6.4 | 1.8 | 0.1 | N/A |
| ESI 8 | 31.4 | 10.8 | 0.3 | 1.0 |
| ESI 9 | 29.9 | 10.3 | 0.3 | 1.1 |
| ESI 10 | 31.4 | 11.0 | 0.4 | 4.3 |
| ESI 11 | 40.6 | 15.5 | NA | 0.6 |
| ESI 12 | 60.5 | 29.2 | 1.4 | 0.5 |

Identification of Other Ingredients

STYRON™ 612 general purpose polystyrene is a trademark of and a product of The Dow Chemical Company.

STYRON™ 685D general purpose polystyrene is a trademark of and a product of The Dow Chemical Company.

LDPE 1 is a high pressure tubular reactor low density polyethylene with an $I_2$ of 2.0 g/10 min and a density of 0.92 g/cm$^3$.

AFFINITY™ HF1030 polyolefm plastomer is a trademark and a product of The Dow Chemical Company.

Elvax™ 450 EVA (18% VA) is a trademark of and a product of the Du Pont Chemical Company.

Elvax™ 150 EVA (32% VA) is a trademark of and a product of the Du Pont Chemical Company.

Elvax™ 40W EVA (40% VA) is a trademark of and a product of the Du Pont Chemical Company.

N351 (ASTM D1765-96) Carbon Black

Piccolastic™ D125 and Hercolyn™ D are trademarks and products of the Hercules Chemical Company.

KT10000 HDPE is a product of BSL Olefinverbund GmbH.

HD35057E HDPE is a product of The Dow Chemical Company.

Eraclene™ BF92 HDPE is a trademark of and a product of Polymeri Europa GmbH.

AL23KA LDPE is a product of BSL Olefinverbund GmbH.

Luvopor™ Blowing Agent is a trademark of and a product of Lehmann & Voss & Co.

VULCAN™ XC72 is a trademark of and a product of Cabot Corporation.

Granule Carbon Black is a product of Denka Corporation.

Silquest™ PA-1 is a trademark of and a product of OSI Specialties, Inc.

AC™400 is a trademark of and a product of AlliedSignal, Inc.

Mixing Procedure for the Compounds in Table 5

Batches of about 1350 g (2.97 lb) of each composition were made up using a Farrell model BR Banbury mixer with a capacity of 1.57 l. Half the base polymer and half the adhesion-adjusting additive were first introduced into the cold Banbury and fluxed at its middle speed setting; the processing aid and antioxidant were added together, followed immediately by the carbon black. The ram was lowered and raised and the remainder of the base polymer and adhesion-adjusting additive were added and blending continued until the temperature reached 135° C. (275° F.). The material was discharged and cooled to ambient temperature, and then half of it reintroduced to the cold Banbury, fluxed and the peroxide added, followed immediately by the remainder of the mixture; blending was continued until the temperature reached 110° C. (230° F.) and the mixture discharged and promptly molded.

The compositions in Table 5 after mixing were made up into molded plaques measuring 150 mm square by 2 mm thick, one face being bonded to a crosslinked polyethylene block of the same dimensions and the two compositions cured together in the press for 20 minutes at 180° C. Adhesion was measured by the peel strength tests detailed below.

Testing

Adhesion Tests

Plaque samples were tested by cutting completely through the thickness of the layer of the experimental shield composition in parallel lines to define a strip 1 inch wide; one end was lifted and turned back 180° to lie along the surface of the portion still adhered, and the force required to peel at a rate of 20 in/min measured; peel strength was calculated in pounds per inch.

Tensile Property Tests

Tensile properties were measured according to ASTM D412.

Water Vapor Transmission Tests

Water vapor transmission was measured according to ASTM F-1249.

Electrical Endurance Test

The Endurance Time is affected by the Field Stress applied to the polymeric composition. In general, as the Applied Field Stress is increased, the time to polymeric failure, as determined from Weibull statistics, i.e., the Endurance Time, decreases. The $\log_{10}$ (Endurance Time) can be plotted against the $\log_{10}$ (Applied Field Stress) to yield a linear plot, which fits the equation of y=mx+b, where y=$\log_{10}$ (Endurance Time in Seconds), m=slope, x=$\log_{10}$ (Applied Field Stress in V/m), and b=linear intercept.

The Endurance Time data of the polymers and compositions of the present invention can be shown to be greater than or equal to values calculated from the linear equation where y=$\log_{10}$ (Endurance Time in Seconds), m=8.56, x=(8.00−$\log_{10}$ (Applied Field Stress in V/m)), and b=4.38=y at $\log_{10}$ (Applied Field Stress) at 8.00.

The Endurance Time data were obtained according to the experimental procedure described in the article entitled "Thermoelectric Aging of Cable Grade XLPE," by C. Griffiths, J. Freestone, and R. Hampton, in the *Conference Record of the* 1998 *IEEE International Symposium on Electrical Insulation,* Arlington, Va., USA, Jun. 7–10, 1998. Test samples were prepared from extruded film having a thickness of 45 to 55 microns ($\mu$m). For each experiment samples were selected with a maximum variation in thickness of +/−2 $\mu$m. Disk shaped samples with a diameter of 32 mm were stamped out of the film samples and fixed centrally over 20 mm circular holes punched in an A4 (29.7 cm×21 cm) sized laminator film.

A sample card was placed on a lower ball bearing electrode array. It was held firmly in place by the two locating pins, put under silicone oil (Dow Corning 200 Fluid 100 centistokes) and trapped air excluded. The upper board was lowered into place over the locating pins. The upper ball bearings were dropped into place through the Tufnol∩ tubes. The aluminum contacts were similarly lowered into place.

The test arrangement provides individual protection for each sample so that as each sample fails this does not interrupt the high voltage supply to the surviving samples. The testing was performed under silicone oil. Experiments were performed at room temperature (nominally 21° C.). The electric fields used were at 50 Hz, and ranged from 110 kV/mm to 209 kV/mm. 16 cells cell-arrays were used to maximize capacity. Test results were acquired electronically by means of a data collection system. Failure Time was defined as the time from when initial voltage was applied, until failure, as monitored by short-circuiting.

Examples 1–12

A series of compositions were prepared comprising a crosslinked ethylene styrene interpolymer (ESI #8). This formulation was chosen because the interpolymer composition is typical of a composition suitable for the device insulator layer, as claimed in this invention. The samples were then submitted for electrical property testing. The resulting data are summarized in Table 3. The data in Table 3 demonstrate that the compositions comprising substantially random interpolymers have electrical properties suitable for use in medium voltage electrical devices, and that the interpolymer compositions are surprisingly stable, as measured, at applied field strengths of 500 Volts AC and 1000 Volts AC.

TABLE 3

| | | | | Electrical Properties* | | | |
|---|---|---|---|---|---|---|---|
| Example # | ESI #* | Thickness (mm) | Temp. (C.) | Power Factor at 500 Volts AC | Dielectric Constant at 500 Volts AC | Power Factor at 1000 Volts AC | Dielectric Constant at 1000 Volts AC |
| Ex. 1 | ESI 8 | 0.92 | 24 | 0.00049 | 2.33 | 0.00047 | 2.33 |
| Ex. 2 | ESI 8 | 0.92 | 44 | 0.00021 | 2.25 | 0.00021 | 2.24 |
| Ex. 3 | ESI 8 | 0.92 | 59 | 0.00017 | 2.18 | 0.00017 | 2.18 |
| Ex. 4 | ESI 8 | 0.92 | 72 | 0.00024 | 2.13 | 0.00025 | 2.13 |
| Ex. 5 | ESI 8 | 0.92 | 81 | 0.00038 | 2.11 | 0.00039 | 2.11 |
| Ex. 6 | ESI 8 | 0.92 | 90 | 0.00058 | 2.08 | 0.00063 | 2.08 |
| Ex. 7 | ESI 8 | 1.59 | 24 | 0.00043 | 2.32 | 0.00058 | 2.32 |
| Ex. 8 | ESI 8 | 1.59 | 44 | 0.00008 | 2.24 | 0.00009 | 2.24 |
| Ex. 9 | ESI 8 | 1.59 | 59 | 0.00011 | 2.16 | 0.00008 | 2.16 |
| Ex. 10 | ESI 8 | 1.59 | 72 | 0.00019 | 2.13 | 0.00018 | 2.13 |
| Ex. 11 | ESI 8 | 1.59 | 81 | 0.00028 | 2.10 | 0.00031 | 2.10 |
| Ex. 12 | ESI 8 | 1.59 | 90 | 0.00052 | 2.08 | 0.00050 | 2.08 |

*Crosslinked with 2 phr Dicumyl Peroxide and degassed before measurements

Examples 13–28 and Comparative Examples 1–4

The electrical endurance properties of conventionally used specially prepared low density polyethylene (Comparative Examples 1 and 2 in Table 4) were measured and compared to a number of different compositions used to prepare the devices of the present invention. The LDPE resins used are considered special high voltage grades, prepared and cleaned in such a way, by the resin manufacturer, so as to be suitable for high voltage insulation. Table 4 shows that compositions comprising the substantially random interpolymers exhibit surprising and unexpected electrical endurance properties. Thus, compositions and devices of the present invention, which comprise such interpolymers in a functional amount, will also exhibit surprising and unexpected breakdown strength. The data in Table 4 also demonstrate that selected interpolymers and interpolymer compositions have superior electrical breakdown strength at high applied field stresses.

TABLE 4

Electrical Endurance Data

| Example # | ESI # | Blend Polymer | log (Applied Field Strength in Volts/Meter) | log (Endurance Time in Seconds) |
|---|---|---|---|---|
| Ex. 13 | 100 wt % ESI 1 | 0 | 8.204 | 2.68 |
| Ex. 14 | 100 wt % ESI 1 | 0 | 8.079 | 4.75 |
| Ex. 15 | 100 wt % ESI 2 | 0 | 8.204 | 3.06 |
| Ex. 16 | 100 wt % ESI 2 | 0 | 8.079 | 5.20 |
| Ex. 17 | 100 wt % ESI 3 | 0 | 8.204 | 4.25 |
| Ex. 18 | 100 wt % ESI 3 | 0 | 8.079 | 5.34 |
| Ex. 19 | 100 wt % ESI 4 | 0 | 8.040 | 4.08 |
| Ex. 20 | 100 wt % ESI 4 | 0 | 8.040 | 4.24 |
| Ex. 21 | 100 wt % ESI 5 | 0 | 8.040 | 5.24 |
| Ex. 22 | 100 wt % ESI 6 | 0 | 8.040 | 5.34 |
| Ex. 23 | 100 wt % ESI 7 | 0 | 8.040 | 5.60 |
| Ex. 24 | 100 wt % ESI 6 | 0 | 8.040 | 6.04 |
| Ex. 25 | 50 wt. % ESI 5 | 50 wt. % STYRON ™ 612 | 8.040 | 4.68 |
| Ex. 26 | 30 wt. % ESI 5 | 70 wt. % STYRON ™ 612 | 8.040 | 4.85 |
| Ex. 27 | 10 wt. % ESI 5 | 90 wt. % STYRON ™ 612 | 8.040 | 4.90 |
| Ex. 28 | 10 wt. % ESI 5 | 90 wt. % STYRON ™ 685D | 8.040 | 4.39 |
| Comp Ex. 1 | 0 | 100 wt. % LDPE 1 | 8.204 | 2.63 |
| Comp Ex. 2 | 0 | 100 wt. % LDPE 1 | 8.079 | 3.70 |
| Comp Ex. 3 | 0 | 100 wt. % OPTICITE ™ 620 | 8.040 | 4.00 |
| Comp Ex. 4 | 0 | 100 wt. % AFFINITY ™ HF1030 | 8.040 | 4.02 |

Examples 29–38 and Comparative Examples 5–8

A series of interpolymer from ESI, EVA, carbon black, processing aids, antioxidants, and other polymeric additives to adjust adhesion to crosslinked polyethylene and otherwise render them suitable for use as a semi-conductive material. These formulations were chosen because they represent the wide range of interpolymer compositions suitable for use in this invention by virtue of their physical properties (tensile strength, elongation, etc.), conductive properties (imparted by the carbon black), and the adhesion level to crosslinked polyethylene. The data in Table 5 demonstrate that the adhesion levels obtained with the ESI compounds are in an acceptable range to be considered 'strippable' as a conductor shield as compared with Comparative Examples 5–8. In addition, the data demonstrates that the copolymer styrene content of the ESI is an effective way to control the adhesion to crosslinked polyethylene, as can also be controlled in EVA polymers by varying the vinyl acetate content as shown in Comparative Examples 5–8. In addition, Example 38 demonstrates that ESI can be used to lower the adhesion when blended with EVA.

TABLE 5

Semi-conductor Shield Data

| | Sample | | | | | | | | | | | | | |
|---|---|---|---|---|---|---|---|---|---|---|---|---|---|---|
| Composition/Property | Ex. 29 | Ex. 30 | Ex. 31 | Ex. 32 | Ex. 33 | Ex. 34 | Ex. 35 | Ex. 36 | Ex. 37 | Ex. 38 | Comp Ex. 5 | Comp Ex. 6 | Comp Ex. 7 | Comp Ex. 8 |
| Elvax ™ 450 (wt %) | 0 | 0 | 0 | 0 | 0 | 0 | 0 | 0 | 0 | 0 | 62.6 | 60.9 | 0 | 0 |
| Elvax ™ 150 (wt %) | 0 | 0 | 0 | 0 | 0 | 0 | 0 | 0 | 0 | 41.4 | 0 | 0 | 61.9 | 0 |
| Elvax ™ 40 W (wt %) | 0 | 0 | 0 | 0 | 0 | 0 | 0 | 0 | 0 | 0 | 0 | 0 | 0 | 61.9 |
| ESI 10 (wt %) | 62.6 | 60.6 | 0 | 0 | 0 | 0 | 0 | 0 | 0 | 0 | 0 | 0 | 0 | 0 |
| ESI 11 (wt %) | 0 | 0 | 61.3 | 56.2 | 56.2 | 59.2 | 0 | 0 | 0 | 0 | 0 | 0 | 0 | 0 |
| ESI 12 (wt %) | 0 | 0 | 0 | 0 | 0 | 0 | 61.3 | 56.2 | 59.2 | 14.9 | 0 | 0 | 0 | 0 |
| VULCAN ™ XC72 (wt %) | 35.6 | 0 | 0 | 0 | 0 | 0 | 0 | 0 | 0 | 0 | 35.6 | 0 | 0 | 0 |
| Denka Granule Carbon Black (wt %) | 0 | 37.6 | 0 | 0 | 0 | 0 | 0 | 0 | 0 | 0 | 0 | 37.6 | 0 | 0 |
| N351 Carbon Black (wt %) | 0 | 0 | 35.3 | 36.6 | 36.6 | 36.6 | 35.3 | 36.6 | 36.6 | 36.6 | 0 | 0 | 35.6 | 35.6 |
| Stearic Acid (wt %) | 0.3 | 0.3 | 1.0 | 0.7 | 0.7 | 0.7 | 1.0 | 0.7 | 0.7 | 0.7 | 0.3 | 0 | 1.0 | 1.0 |
| AC ™ 400 (wt %) | 0 | 0 | 0 | 0 | 0 | 0 | 0 | 0 | 0 | 5.0 | 0 | 0 | 0 | 0 |
| Antioxidant* (wt %) | 0.5 | 0.5 | 0.5 | 0.5 | 0.5 | 0.5 | 0.5 | 0.5 | 0.5 | 0.5 | 0.5 | 0.5 | 0.5 | 0.5 |
| Dicumyl Peroxide (%) | 1.0 | 1.0 | 2.0 | 1.0 | 1.0 | 1.0 | 2.0 | 1.0 | 1.0 | 1.0 | 1.0 | 1.0 | 1.0 | 1.0 |
| Piccolastic ™ D125 (wt %) | 0 | 0 | 0 | 5.0 | 0 | 0 | 0 | 5.0 | 0 | 0 | 0 | 0 | 0 | 0 |
| Silquest ™ PA-1 (wt %) | 0 | 0 | 0 | 0 | 0 | 2.0 | 0 | 0 | 2.0 | 0 | 0 | 0 | 0 | 0 |
| Hercolyn ™ D (wt %) | 0 | 0 | 0 | 0 | 5.0 | 0 | 0 | 0 | 0 | 0 | 0 | 0 | 0 | 0 |
| Tensile Strength (PSI) | 2500 | 2140 | NA | NA | NA | NA | NA | NA | NA | NA | 2400 | 2000 | NA | NA |
| Elongation at Break (%) | 340 | 295 | NA | NA | NA | NA | NA | NA | NA | NA | 230 | 200 | NA | NA |
| Water Vapor Transmission Rate (g/m2/day) | 2.8 | 2.8 | NA | NA | NA | NA | NA | NA | NA | NA | 6.1 | 6.1 | NA | NA |

TABLE 5-continued

| Composition/Property | Ex. 29 | Ex. 30 | Ex. 31 | Ex. 32 | Ex. 33 | Ex. 34 | Ex. 35 | Ex. 36 | Ex. 37 | Ex. 38 | Comp Ex. 5 | Comp Ex. 6 | Comp Ex. 7 | Comp Ex. 8 |
|---|---|---|---|---|---|---|---|---|---|---|---|---|---|---|
| | Semi-conductor Shield Data | | | | | | | | | | | | | |
| | Sample | | | | | | | | | | | | | |
| Plaque Adhesion (lbs. per 0.5 inch) | NA | NA | 16 | 12 | 13 | 14 | 10 | 9 | 7 | 12 | NA | NA | 19 | 10 |

*polymerized 1,2-dihydro-2,2,4-trimethylquinoline

Examples 39–49 and Comparative Examples 9–10

A series of compositions were prepared from polyethylenic resins blends with an interpolymer. These compositions were modified by the addition of a blowing agent and processing aid to make them suitable for use as a foamed telecommunication cable insulation. These formulations were chosen because they represent typical polyethylenic blend compositions that could be employed in the present invention. The data in Table 6 show that the incorporation of interpolymers into foamed insulation compositions improves the mechanical properties after heat aging. Examples 39–49 have the interpolymer incorporated; Comparative Examples 9 and 10 are without the interpolymer, and show a dramatic loss in Elongation at Rupture after heat aging. The data further demonstrate that even as a minor component, the interpolymer surprisingly and unexpectedly imparts excellent performance properties to the polyethylenic composition.

TABLE 6

Cellular Insulation Data

| Sample | ESI 9 (wt %) | KT10000 HDPE (wt %) | HD35057E HDPE (wt %) | Eraclene ™ BF92 HDPE (wt %) | AL23KA LDPE (wt %) | Luvopor ™ Blowing Agent (wt %) | Calcium Stearate (wt %) | Tensile Strength (MPa) | Elongation at Rupture (%) | Tensile Strength (after Aging) (10 days at 100 C.) (MPa) | Elongation at Rupture (after Aging) (10 days at 100 C.) (%) |
|---|---|---|---|---|---|---|---|---|---|---|---|
| Ex. 39 | 10 | 18 | 37 | 0 | 30 | 5 | 0 | 19.2 | 737 | 18.4 | 765 |
| Ex. 40 | 30 | 18 | 17 | 0 | 30 | 5 | 0 | 16.5 | 500 | 16.8 | 509 |
| Ex. 41 | 10 | 0 | 0 | 50 | 35 | 5 | 0 | 18.1 | 725 | 18.4 | 673 |
| Ex. 42 | 20 | 0 | 0 | 40 | 35 | 5 | 0 | 17.5 | 583 | 16.4 | 545 |
| Ex. 43 | 35 | 0 | 0 | 25 | 35 | 5 | 0 | 17.8 | 526 | 17.1 | 511 |
| Ex. 44 | 95 | 0 | 0 | 0 | 0 | 5 | 0 | 32.5 | NA | 505 | NA |
| Ex. 45 | 94.5 | 0 | 0 | 0 | 0 | 5 | 0.5 | 36.2 | NA | 500 | NA |
| Ex. 46 | 94 | 0 | 0 | 0 | 0 | 5 | 1 | 35.9 | NA | 504 | NA |
| Ex. 47 | 85 | 0 | 0 | 0 | 10 | 5 | 0 | 37.1 | NA | 497 | NA |
| Ex. 48 | 65 | 0 | 0 | 0 | 30 | 5 | 0 | 28.4 | 24.4 | 498 | 503 |
| Ex. 49 | 45 | 0 | 0 | 0 | 50 | 5 | 0 | 19.9 | 20.4 | 524 | 515 |
| Comp Ex. 9 | 0 | 18 | 47 | 0 | 30 | 5 | 0 | 20.8 | 791 | 22.0 | 126 |
| Comp Ex. 10 | 0 | 0 | 0 | 60 | 35 | 5 | 0 | 21.7 | 834 | 22.6 | 18 |

We claim:

1. An electrically conductive device comprising:

(a) at least one electrically conductive substrate; and (b) at least one interpolymer layer wherein the interpolymer layer comprises a composition comprising at least one substantially random interpolymer comprising:

(i) polymer units derived from (a) at least one vinyl or vinylidene aromatic monomer, or (b) at least one hindered aliphatic or cycloaliphatic vinyl or vinylidene monomer; or (c) a combination of at least one vinyl or vinylidene aromatic monomer and at least one hindered aliphatic or cycloaliphatic vinyl or vinylidene monomer; and (ii) polymer units derived from at least one aliphatic olefin monomer having from about 2 to about 20 carbon atoms, the interpolymer having from about 5 to about 40 mole percent aromatic monomer content and a log 10 (Endurance Time in Seconds) greater than or equal to {8.56[8.00−log10 (Applied Field Stress in V/m)]+4.7}, in the Applied Field Stress range of log10 (Applied Field Stress in V/m) is greater than or equal to 8.00, but less than or equal to 8.25.

2. The electrically conductive device of claim 1, wherein the at least one substantially random interpolymer comprises one or more vinyl aromatic monomers in combination with ethylene or a combination of ethylene and one or more C3 to C12 alpha olefin monomers, or a combination of ethylene and norbornene.

3. The electrically conductive device of claim 1, wherein the at least one substantially random interpolymer is selected from the group consisting of ethylene/styrene, ethylene/propylene/styrene, ethylene/butene/styrene, ethylene/pentene/styrene, ethylene/hexene-1/styrene, and ethylene/octene-1/styrene.

4. The electrically conductive device of claim 1, wherein the at least one substantially random interpolymer comprises from 50 mole percent to 97 mole percent ethylene, based on the moles of monomer.

5. The electrically conductive device of claim 1, wherein the electrically insulating composition further comprises at least one water treeing inhibitor.

6. The electrically conductive device of claim 1, wherein the at least one substantially random interpolymer further comprises up to 70 weight percent, based on the polymer, of one or more fillers selected from the group consisting of clay, calcium carbonate, talc, magnesium hydroxide and aluminum trihydrate.

7. The electrically conductive device in accordance with claim 1, wherein the at least one substantially random interpolymer composition further comprises an amount of up to 90 weight percent of at least one thermoplastic polymer.

8. The electrically conductive device in accordance with claim 1, wherein at least one of the interpolymer compositions further comprises an amount of up to 90 weight percent of at least one thermoplastic polymer selected from ethylene homopolymer and copolymers, propylene homopolymer and copolymers, styrenic homopolymer and copolymers, polyaromatic ethers and polyvinyl halides.

9. The electrically conductive device in accordance with claim 1, wherein at least one polymer composition is cross linked.

10. The electrically conductive device in accordance with claim 1, wherein at least one polymer composition is crosslinked with an organic peroxide, with a hydrolyzed silane, an organic azide, with radiation or a combination of these.

11. The electrically conductive device in accordance with claim 1, wherein at least one polymer composition is foamed.

12. The electrically conductive device in accordance with claim 1, wherein the interpolymer has been formed by polymerizing monomers utilizing a metallocene catalyst system.

13. The electrically conductive device in accordance with claim 1, wherein at least one of the interpolymer components has a vinyl aromatic comonomer content of greater than about 10 mole percent, and a melt index, I2, of from about 0.01 to about 50 g/10 min.

14. The electrically conductive device in accordance with claim 1, wherein at least one of the interpolymer components has a vinyl aromatic comonomer content of greater than about 25 mole percent, and a melt index I2, of from about 0.01 to about 50 g/10 min.

15. The electrically conductive device as recited in claim 1, wherein after polymerization of the interpolymer, steam is introduced into the interpolymer and then is removed.

16. An electrically conductive device comprising:

(a) at least one electrically conductive substrate; and (b) at least one substantially random interpolymer comprising:

first polymer units derived from first unit selected from the group consisting of vinyl monomer, vinylidene aromatic monomer, hindered aliphatic monomer, hindered cycloaliphatic vinyl monomer, hindered vinylidene monomer, a combination of at least one vinyl monomer or vinylidene aromatic monomer and at least one hindered aliphatic monomer or hindered cycloaliphatic vinyl monomer and hindered vinylidene monomer; and second polymer units derived from at least one aliphatic olefin monomer having from about 2 to about 20 carbon atoms, the interpolymer having from about 5 to about 40 mole percent aromatic monomer content, a melt index I2 of from about 0.01 for about 50 g/10 minutes and a log10 (Endurance Time in Seconds) greater than or equal to {8.56[8.00–log10 (Applied Field Stress in V/m)]+4.7}, in the Applied Field Stress range of log10 (Applied Field Stress in V/m) is greater than or equal to 8.00, but less than or equal to 8.25.

17. The electrically conductive device as recited in claim 16, wherein the interpolymer is formed by polymerizing monomers utilizing a metallocene catalyst system.

18. The electrically conductive device as recited in claim 16, wherein after polymerization of the interpolymer, steam is introduced into the interpolymer and then is removed.

19. The electrically conductive device as recited in claim 16, wherein at least one substantially random interpolymer further comprises up to 90 weight percent of at least one thermoplastic polymer.

20. The electrically conductive device as recited in claim 16, wherein the interpolymer comprises an aromatic monomer content of greater than about 10 mole percent of vinyl aromatic monomer.

21. An electrically conductive device comprising:

(a) at least one electrically conductive substrate; and (b) at least one interpolymer layer wherein the interpolymer layer comprises a composition comprising at least one substantially random interpolymer comprising:

(i) polymer units derived from (a) at least one vinyl or vinylidene aromatic monomer, or (b) at least one hindered aliphatic or cycloaliphatic vinyl or vinylidene monomer; or (c) a combination of at least one vinyl or vinylidene aromatic monomer and at least one hindered aliphatic or cycloaliphatic vinyl or vinylidene monomer; and (ii) polymer units derived from at least one aliphatic olefin monomer having from about 2 to about 20 carbon atoms, the interpolymer having a log10 (Endurance Time in Seconds) greater than or equal to {8.56[8.00–log 10 (Applied Field Stress in V/m)]+4.7}, in the Applied Field Stress range of log10 (Applied Field Stress in V/m) is greater than or equal to 8.00, but less than or equal to 8.25.

22. The electrically conductive device as recited in claim 21, wherein after polymerization of the interpolymer, steam is introduced into the interpolymer and then is removed.

* * * * *